US009928796B2

(12) United States Patent
Nakatani et al.

(10) Patent No.: US 9,928,796 B2
(45) Date of Patent: Mar. 27, 2018

(54) DISPLAY DEVICE AND DISPLAY METHOD

(71) Applicant: Sharp Kabushiki Kaisha, Sakai, Osaka (JP)

(72) Inventors: Aya Nakatani, Sakai (JP); Kohhei Tanaka, Sakai (JP); Shigeto Yoshida, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 15/316,953

(22) PCT Filed: Jun. 23, 2015

(86) PCT No.: PCT/JP2015/067957

§ 371 (c)(1),
(2) Date: Dec. 7, 2016

(87) PCT Pub. No.: WO2015/199049

PCT Pub. Date: Dec. 30, 2015

(65) Prior Publication Data

US 2017/0116946 A1 Apr. 27, 2017

(30) Foreign Application Priority Data

Jun. 23, 2014 (JP) ..... 2014-128074

(51) Int. Cl.
*G09G 3/36* (2006.01)

(52) U.S. Cl.
CPC ... *G09G 3/3677* (2013.01); *G09G 2300/0426* (2013.01); *G09G 2310/0251* (2013.01); *G09G 2310/06* (2013.01); *G09G 2310/08* (2013.01)

(58) Field of Classification Search
CPC ..... G09G 3/3677; G09G 3/3648; G09G 2300/0426; G09G 2310/0251;
(Continued)

(56) References Cited

U.S. PATENT DOCUMENTS 5,648,793 A * 7/1997 Chen ..... G09G 3/3614 345/209
7,505,026 B2 * 3/2009 Baba ..... G09G 3/3648 345/102
(Continued)

FOREIGN PATENT DOCUMENTS

JP 2001356746 A 12/2001
JP 2005025076 A 1/2005
(Continued)

OTHER PUBLICATIONS

International Search Report PCT/ISA/210 for International Application No. PCT/JP2015/067957 dated Oct. 6, 2015.

*Primary Examiner* — Stacy Khoo
(74) *Attorney, Agent, or Firm* — ScienBiziP, P.C.

(57) ABSTRACT

A scanning signal is precisely output to a scanning signal line corresponding to a row range even in a case where a plurality of scanning signals (including a precharge signal) are output at the same time. A display control circuit of the display device sets row selection enable signals at H level so that main charging periods are set in a range from an ith row to an mth row, which corresponds to a moving image region, and precharging periods corresponding to the main charging periods are also set. Accordingly, a precise scanning signal in which a precharging period having a necessary length is set and no unnecessary precharging period is set at all is output to each of scanning signal lines connected to a scanning signal line driving circuit, so that deterioration of display quality is prevented.

7 Claims, 24 Drawing Sheets

(58) Field of Classification Search
CPC ..... G09G 2310/0286; G09G 2310/067; G09G 2310/08; G09G 2320/103
USPC ..... 345/87–104, 204, 209, 210–213
See application file for complete search history.

(56) References Cited

U.S. PATENT DOCUMENTS

| | | | | |
|---|---|---|---|---|
| 7,710,377 | B2 * | 5/2010 | Kang | G09G 3/3614 345/209 |
| 2001/0052887 | A1 | 12/2001 | Tsutsui et al. | |
| 2006/0077168 | A1 | 4/2006 | Fujita | |
| 2014/0028657 | A1 | 1/2014 | Kobayashi et al. | |

FOREIGN PATENT DOCUMENTS

| | | | |
|---|---|---|---|
| JP | 2006106460 | A | 4/2006 |
| JP | 2012078623 | A | 4/2012 |
| WO | WO-2012137799 | A1 | 10/2012 |

* cited by examiner

FIG. 9

| | 4k+1 | 4k+2 | 4k+3 | 4k |
|---|---|---|---|---|
| EN1 | i−3 | i | i−1 | i−2 |
| EN2 | i−2 | i−3 | i | i−1 |
| EN3 | i−1 | i−2 | i−3 | i |
| EN4 | i | i−1 | i−2 | i−3 |

k: CONSTANT

FIG. 14

| | 4k+1 | 4k+2 | 4k+3 | 4k |
|---|---|---|---|---|
| EN1 | m | m−1 | m−2 | m−3 |
| EN2 | m−3 | m | m−1 | m−2 |
| EN3 | m−2 | m−3 | m | m−1 |
| EN4 | m−1 | m−2 | m−3 | m |

k: CONSTANT

DISPLAY DEVICE AND DISPLAY METHOD

TECHNICAL FIELD

The present invention relates to a display device of an active matrix type and a display method for the display device.

BACKGROUND ART

In recent years, in order to reduce power consumption of a liquid crystal display device, a scanning stop period is provided in some cases, during which a state of not changing a voltage applied to a liquid crystal element is maintained for a predetermined period while display is performed. By inserting such a scanning stop period (pause period), it is possible to meet a demand of reducing power consumption, for example, in a mobile terminal or the like, while continuing displaying a still image.

Moreover, there are some display devices which, by providing such a scanning stop period not to all rows but to a predetermined row range, perform normal display only in a part of a screen and continue displaying a still image in a remaining part of the screen, which corresponds to the row range (such a display method is also called partial display).

For example, in Japanese Unexamined Patent Application Publication No. 2001-356746, described is a configuration in which an enable signal ENB is provided and a scanning signal is output from a gate driver only in a case where the enable signal ENB is active during a scanning period. With this configuration, by appropriately setting an active period of the enable signal ENB, it is possible to output the scanning signal only to a scanning signal line corresponding to a predetermined row range, and to perform the partial display with which normal display is performed in the row range and a still image is continued to be displayed in the remaining part.

CITATION LIST

Patent Literature

PTL 1: Japanese Unexamined Patent Application Publication No. 2001-356746

SUMMARY OF INVENTION

Technical Problem

However, in the conventional configuration described in PTL 1 above, it is assumed that scanning signals are sequentially output (to each scanning signal line) from the gate driver. Thus, in a case where a plurality of scanning signals including a precharge signal are output at the same time, for example, in the case of performing precharging by which insufficient charging for a pixel capacitor is resolved, it may be difficult to precisely output a scanning signal to a scanning signal line corresponding to the predetermined row range. Specifically, there are problems that, in some cases, a precharge signal is output in a period other than the active period of the enable signal ENB, or a necessary precharge signal is not output in the active period of the enable signal ENB.

The invention aims to provide a display device and a display method by which a scanning signal is able to be precisely output to a scanning signal line corresponding to a predetermined row range even in a case where a plurality of scanning signals (including a precharge signal) are output at the same time.

Solution to Problem

A first aspect of the invention is a display device that displays an image by a plurality of pixel forming parts that are arranged along a plurality of video signal lines with which a plurality of video signals are transmitted and a plurality of scanning signal lines that intersect with the plurality of video signal lines, the display device including:

a video signal line driving circuit that drives the plurality of video signal lines based on an image signal that indicates the image;

a scanning signal line driving circuit that outputs a main selection signal, with which the plurality of scanning signal lines are individually selected per unit selection period in turn in order to cause the plurality of pixel forming parts to display the image, and a preliminary selection signal, with which the plurality of scanning signal lines are individually selected in turn during (n−1) unit selection period immediately before the main selection signal in order to perform preliminary charging before displaying the image, to each of the plurality of scanning signal lines so that phases are different between unit selection periods; and a display control circuit that controls the video signal line driving circuit and the scanning signal line driving circuit, in which the display control circuit supplies, to the scanning signal line driving circuit, at least n row selection enable signals with which selection of a range of the plurality of scanning signal lines, which is designated from an outside of the device, is permitted, and causes a scanning signal line in the range to output the main selection signal and the preliminary selection signal and causes a scanning signal line outside the range to output neither the main selection signal nor the preliminary selection signal.

In a second aspect of the invention, based on the first aspect of the invention, the display control circuit supplies an n-phase clock signal, with which the preliminary selection signal and the main selection signal are generated, to the scanning signal line driving circuit, and supplies, to the scanning signal line driving circuit, the n row selection enable signals which store therein n patterns of rising time points and n patterns of falling time points of the n row selection enable signals, which are defined in advance, and rising time points and falling time points of which are determined in accordance with the range based on the stored patterns.

In a third aspect of the invention, based on the second aspect of the invention, the scanning signal line driving circuit causes the n row selection enable signals to respectively correspond to scanning signal line groups, which are obtained by being made into n groups, one by one based on the n-phase clock signal, and sequentially outputs the main selection signal and the preliminary selection signal to a scanning signal line for which selection is permitted by the row selection enable signals.

In a fourth aspect of the invention, based on the second aspect of the invention, the display control circuit determines rising time points and falling time points of the n row selection enable signals based on the rising time points of n patterns, which are defined in accordance with a remainder of dividing i (i is a natural number) by n, and the falling time points of n patterns, which are defined in accordance with a remainder of dividing m (m is a natural number larger than i) by n, based on an ith row serving as a starting row and an mth row serving as a finishing row in the range.

In a fifth aspect of the invention, based on the second aspect of the invention, the display control circuit determines first rising time points and first falling time points of the n row selection enable signals based on the rising time points of n patterns, which are defined in accordance with a remainder of dividing i (i is a natural number) by n, and the falling time points of n patterns, which are defined in accordance with a remainder of dividing j (j is a natural number larger than i) by n, based on an ith row serving as a starting row and a jth row serving as a finishing row in a first region of the first and a second regions in the range, which are different, and determines second rising time points and second falling time points of the n row selection enable signals based on the rising time points of n patterns, which are defined in accordance with a remainder of dividing l (l is a natural number larger than j) by n, and the falling time points of n patterns, which are defined in accordance with a remainder of dividing m (m is a natural number larger than l) by n, based on an lth row serving as a starting row and an mth row serving as a finishing row in the second region of the first and the second regions in the range, which are different.

In a sixth aspect of the invention, based on the first aspect of the invention, the display control circuit, based on the image signal, controls the video signal line driving circuit so as to drive the plurality of video signal lines in every predetermined frame cycle in a normal display region corresponding to the range in a display region of the image, and controls the video signal line driving circuit so as to drive the plurality of video signal lines in a cycle longer than the frame cycle in a pause drive region that is a display region other than the normal display region.

A seventh aspect of the invention is a display method of displaying an image on a display device that includes a plurality of pixel forming parts that are arranged along a plurality of video signal lines with which a plurality of video signals are transmitted and a plurality of scanning signal lines that intersect with the plurality of video signal lines, the method including:

a video signal line driving step of driving the plurality of video signal lines based on an image signal that indicates the image;

a scanning signal line driving step of outputting a main selection signal, with which the plurality of scanning signal lines are individually selected per unit selection period in turn in order to cause the plurality of pixel forming parts to display the image, and a preliminary selection signal, with which the plurality of scanning signal lines are individually selected in turn during (n−1) unit selection period immediately before the main selection signal in order to perform preliminary charging before displaying the image, to each of the plurality of scanning signal lines so that phases are different between unit selection periods; and a display control step of controlling the video signal line driving step and the scanning signal line driving step, in which at the display control step, to the scanning signal line driving step, at least n row selection enable signals with which selection of a range of the plurality of scanning signal lines, which is designated from an outside of the device, is permitted are supplied, and a scanning signal line in the range is caused to output the main selection signal and the preliminary selection signal and a scanning signal line outside the range is caused to output neither the main selection signal nor the preliminary selection signal.

Advantageous Effects of Invention

According to the first aspect of the invention, differently from a case where there is only one row selection enable signal, since, for example, a preliminary charging period (precharging period) having a necessary length is set with respect to a scanning signal line corresponding to a moving image region, and no unnecessary precharging period is set, abnormality of display gradation due to lack of the precharging period or display of noise due to addition of an unnecessary precharging period is not caused, so that it is possible to prevent display quality from being deteriorated.

According to the second aspect of the invention, with a configuration in which rising patterns and falling patterns of the row selection enable signals are stored in advance, one of the patterns may be selected in accordance with a starting row and a finishing row of a moving image region to set rising time points and falling time points, for example, and it is possible to realize partial display with a simple configuration, and to reduce a region in which the patterns are stored.

According to the third aspect of the invention, it is possible to realize a scanning signal line driving circuit with a simple configuration, and further, when forming the scanning signal line driving circuit integrally with a substrate, it is possible to realize frame narrowing of a display panel.

According to the fourth aspect of the invention, it is possible to determine rising time points and falling time points of the n row selection enable signals with a simple configuration, for example, based on the ith row serving as the starting row and the mth row serving as the finishing row in a moving image region.

According to the fifth aspect of the invention, it is possible to determine rising time points and falling time points of the n row selection enable signals with a simple configuration, for example, based on starting rows and finishing rows individually corresponding to two moving image regions.

According to the sixth aspect of the invention, by performing drive in the pause drive region in a cycle longer than that in the normal display region, it is possible to realize partial display.

According to the seventh aspect of the invention, it is possible to obtain an effect similar to that of the invention of the device, which is the first aspect of the invention, also in the invention of a method.

BRIEF DESCRIPTION OF DRAWINGS

FIG. 9 is a view illustrating a relation between rising time of row selection enable signals EN1 to EN4 and a starting position of the moving image region in the embodiment.

FIG. 14 is a view illustrating a relation between falling time of the row selection enable signals EN1 to EN4 and a finishing position of the moving image region in the embodiment.

DESCRIPTION OF EMBODIMENTS

Hereinafter, embodiments of the invention will be described with reference to appended drawings. Note that, a liquid crystal display device is described below as an example of the embodiments of the invention, but the invention is not limited to the liquid crystal display device and is applicable to a display device other than the liquid crystal display device, such as an organic EL display device of an active matrix type. In addition, hereinafter, constituents (typically, pixel forming parts or pixel regions corresponding thereto) which are arranged in a display portion in a direction in which a video signal line is extended are referred to as a "column", and constituents (typically, pixel forming parts or pixel regions corresponding thereto) which are arranged in a direction in which a scanning signal line is extended are referred to as a "row", in some cases.

1. First Embodiment

<1.1 Entire Configuration and Operation of Liquid Crystal Display Device>

Figure 1:
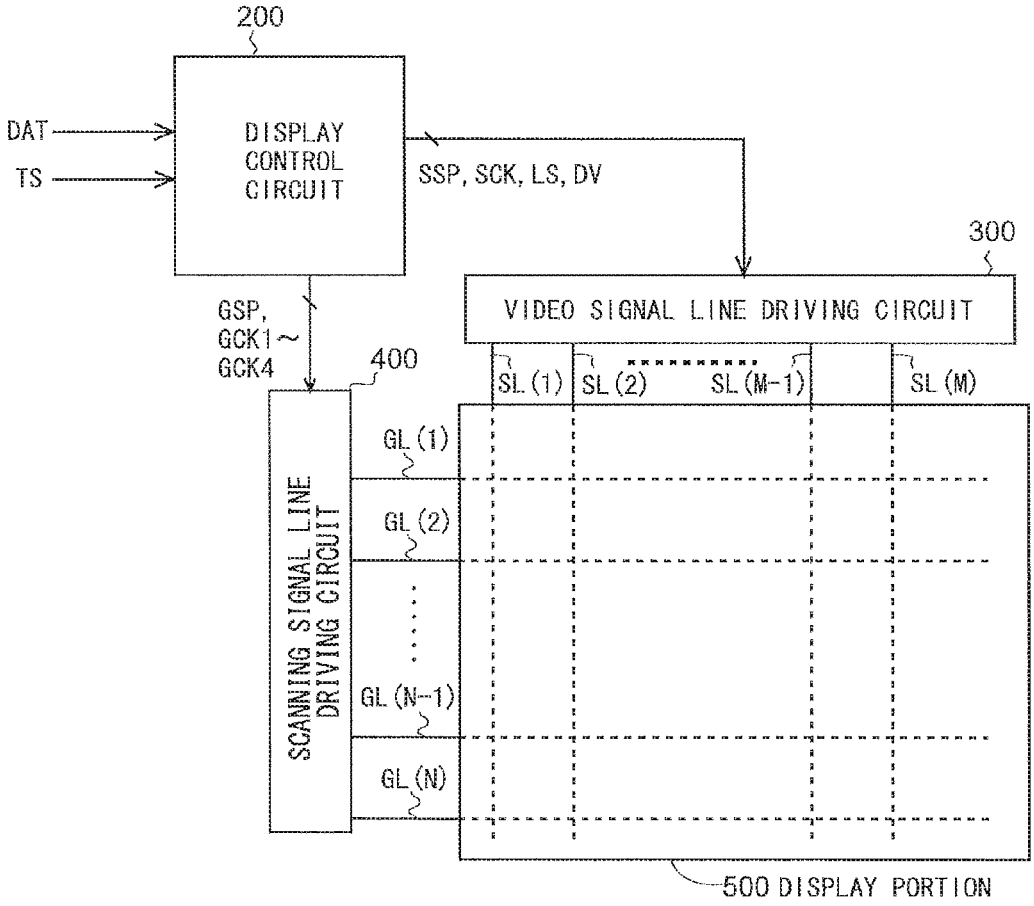
FIG. 1 is a block diagram illustrating a configuration of a liquid crystal display device according to a first embodiment of the invention.
Figure 2:
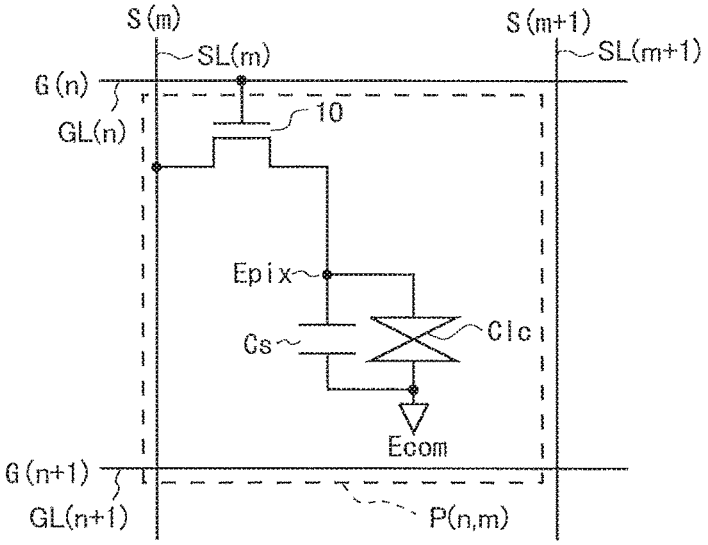
FIG. 2 is an equivalent circuit diagram of a pixel forming part P(n, m) which is included in a display portion in the embodiment.

FIG. 1 is a block diagram illustrating an entire configuration of a liquid crystal display device of an active matrix type according to a first embodiment of the invention. The liquid crystal display device includes a drive controller composed of a display control circuit 200, a video signal line driving circuit (source driver) 300, and a scanning signal line driving circuit (gate driver) 400, and a display portion 500. The display portion 500 includes a plurality of (M) video signal lines SL(1) to SL(M), a plurality of (N) scanning signal lines GL(1) to GL(N), and a plurality of (M×N) pixel forming parts which are provided so as to individually correspond to intersections of the plurality of video signal lines SL(1) to SL(M) and the plurality of scanning signal lines GL(1) to GL(N) (hereinafter, a pixel forming part corresponding to an intersection of a scanning signal line GL(n) and a video signal line SL(m) is indicated with a reference sign "P(n, m)"), and each of the pixel forming parts P(n, m) has a configuration illustrated in FIG. 2. FIG. 2 illustrates an equivalent circuit of the pixel forming part P(n, m) in the display portion 500.

As illustrated in FIG. 2, each of the pixel forming parts P(n, m) is constituted by a TFT (Thin Film Transistor) 10 which is a switching element a gate terminal of which is connected to a scanning signal line GL(n) passing through a corresponding intersection and a source terminal of which is connected to a video signal line SL(m) passing through the corresponding intersection, a pixel electrode Epix which is connected to a drain terminal of the TFT 10, a common electrode (also referred to as "counter electrode") Ecom which is provided commonly to the plurality of pixel forming parts P(n, m) (n=1 to N, and m=1 to M), and a liquid crystal layer as an electrooptical element, which is provided commonly to the plurality of pixel forming parts P(n, m) (n=1 to N, and m=1 to M) and held between the pixel electrode Epix and the common electrode Ecom.

Note that, in general liquid crystal display devices, alternating drive is performed to suppress deterioration of liquid crystal and maintain display quality. A frame inversion drive system which is a drive system by which a positive/negative polarity of a voltage applied to a pixel liquid crystal is inverted for each frame is adopted also in the present embodiment. Alternatively, a line inversion drive system which is a drive system by which a positive/negative polarity of a voltage applied to a pixel liquid crystal is inverted for each row in the display portion 500 (and inverted for each frame) may be adopted. Further, a frame rate frequency thereof is generally 60 Hz, and this liquid crystal display device also performs display with a frequency similar to a normal one.

As illustrated in FIG. 2, in each of the image forming parts P(n, m), a liquid crystal capacitor Clc is formed by the pixel electrode Epix and the common electrode Ecom which is opposed thereto with the liquid crystal layer held therebetween, and an auxiliary capacitor Cs is formed in a vicinity thereof. The auxiliary capacitor Cs is connected in parallel to the liquid crystal capacitor Clc, and a pixel capacitor for holding a voltage of a video signal for driving S(m), which will be described below, as a pixel value is constituted by such a liquid crystal capacitor Clc and an auxiliary capacitor Cs in the present embodiment. However, the pixel capacitor may be constituted only by the liquid crystal capacitor Clc.

When a scanning signal G(n) to be applied to the scanning signal line GL(n) becomes active and this scanning signal line is thereby selected, the TFT 10 is brought into a conductive state. Then, the video signal for driving S(m) is applied to the pixel electrode Epix via the video signal line SL(m). Thereby, a voltage (voltage with a potential of the common electrode Ecom as a reference) of the applied video signal for driving S(m) is written in the pixel forming part P(n, m), which includes this pixel electrode Epix, as a pixel value.

The display control circuit 200 receives a display data signal DAT and a timing control signal TS which are transmitted from an outside and outputs digital image signals DV, and a source start pulse signal SSP, a source clock signal SCK, a latch strobe signal LS, gate start pulse signals GSP, gate clock signals GCK1 to GCK4, and row selection enable signals EN1 to EN4 which are for controlling a timing of displaying an image on the display portion 500. Note that, the gate clock signals GCK1 to GCK4 are composed of gate clocks CK1 to CK4 and inverted gate clocks CK1B to CK4B as described below. The display control circuit 200 supplies a polarity inversion signal to a common electrode driving circuit which is not illustrated, and the common electrode driving circuit inverts the potential of the common electrode Ecom, which is described above, at an appropriate timing to thereby perform alternating drive.

The video signal line driving circuit 300 receives the digital image signals DV, the source start pulse signal SSP, the source clock signal SCK, and the latch strobe signal LS, which are output from the display control circuit 200, and applies video signals for driving to the respective video signal lines SL(1) to SL(M) in order to charge a pixel capacitor of each of the pixel forming parts P(n, m) in the display portion 500. At this time, in the video signal line driving circuit 300, the digital image signals DV each of which indicates a voltage to be applied to each of the video signal lines SL(1) to SL(M) are held sequentially at a timing when a pulse of the source clock signal SCK is generated. Then, at a timing when a pulse of the latch strobe signal LS is generated, the held digital image signals DV are converted into analogue voltages. The converted analogue voltages are simultaneously applied to all of the video signal lines SL(1) to SL(M) as the video signals for driving. That is, in the present embodiment, a line-sequential drive system is adopted as a drive system of the video signal lines SL(1) to SL(M).

Based on the gate start pulse signals GSP and the gate clock signals GCK1 to GCK4 which are output from the display control circuit 200, the scanning signal line driving circuit 400 sequentially applies active scanning signals to the respective scanning signal lines GL(1) to GL(N). Each of the scanning signals includes a precharging period (preliminary charging period) and a main charging period, and a video signal for driving which is supplied in the main charging period is written as the pixel value in the end. Hereinafter, a configuration of the scanning signal line driving circuit 400 will be described with reference to FIG. 3.

Figure 3:
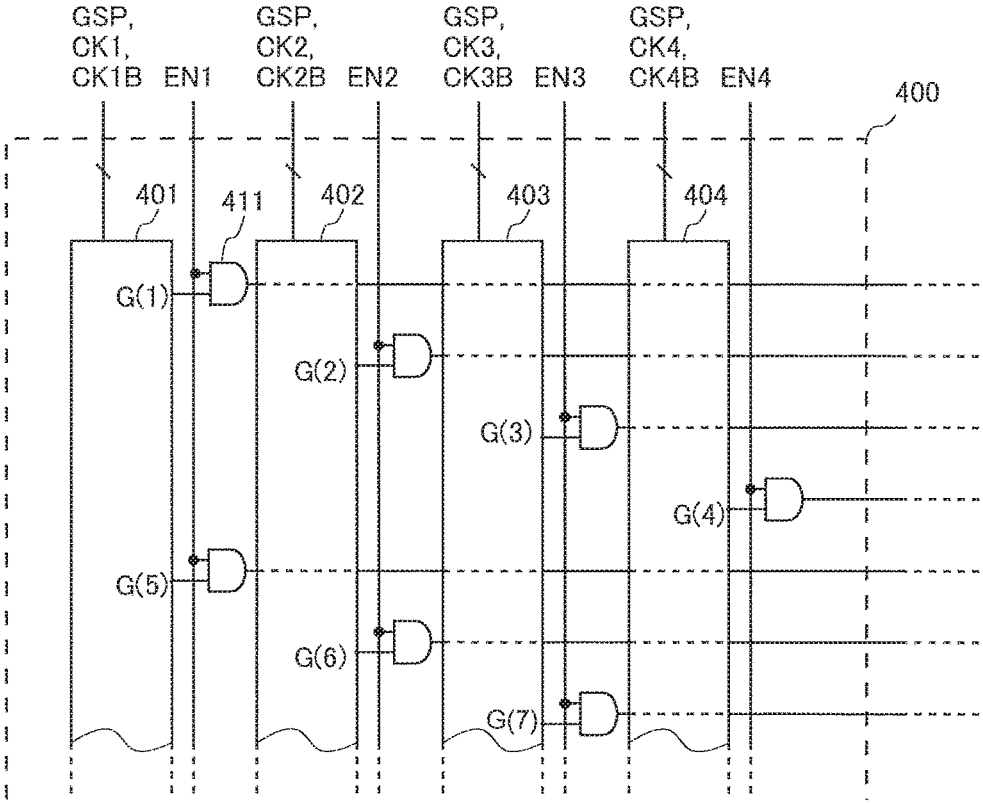
FIG. 3 is a block diagram illustrating a detailed configuration of a scanning signal line driving circuit in the embodiment.
Figure 6:
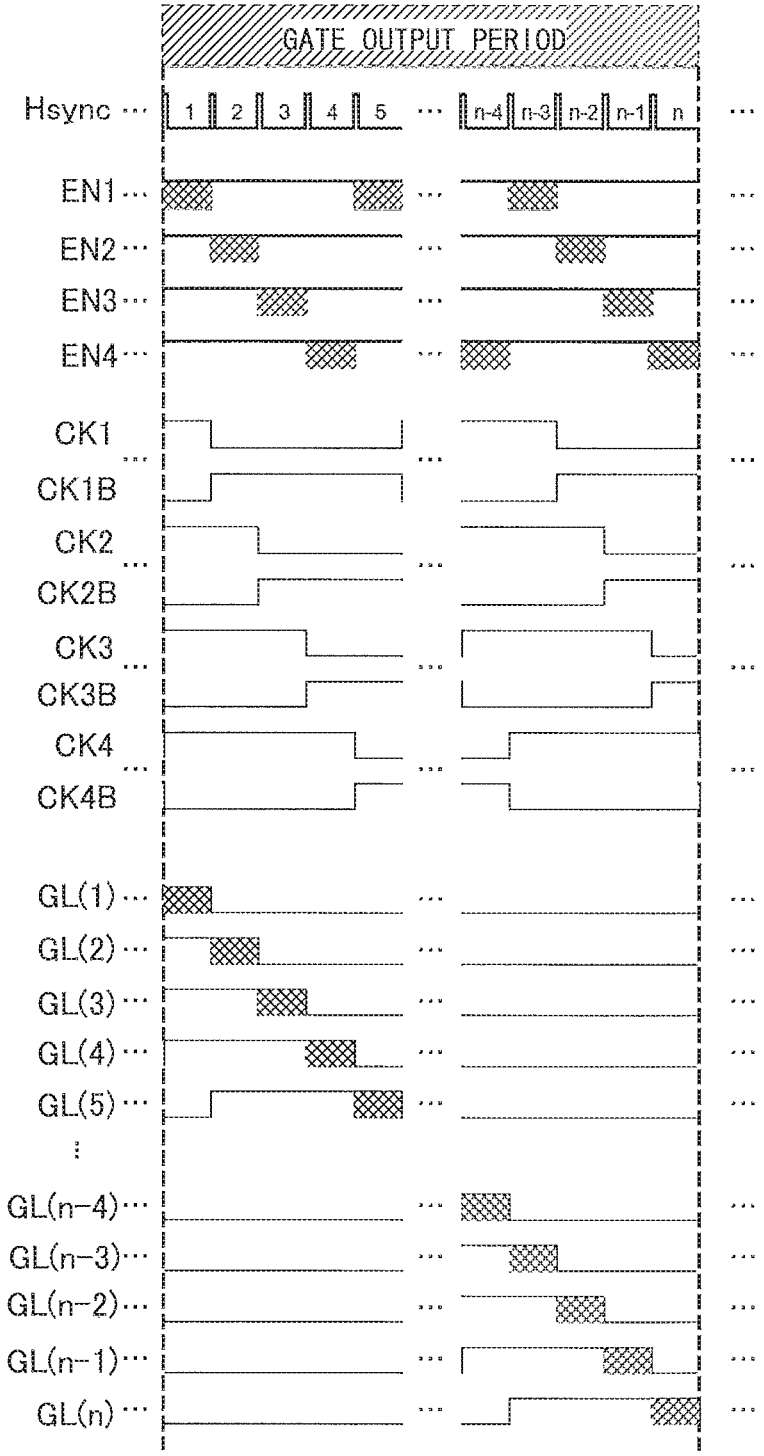
FIG. 6 is a waveform chart of various signals of a first frame, during which a whole screen is rewritten, in the embodiment.

FIG. 3 is a block diagram illustrating the detailed configuration of the scanning signal line driving circuit 400. As illustrated in FIG. 3, the scanning signal line driving circuit 400 includes four shift resisters 401 to 404 and AND circuits 411 which are connected to output terminals of the shift registers 401 to 404 one by one. To the shift registers 401 to 404, the gate clocks CK1 to CK4 which become active for a length corresponding to four horizontal synchronizing periods composed of the precharging period having a length corresponding to three horizontal synchronizing periods and the main charging period having a length corresponding to one horizontal synchronizing period and become non-active for a length corresponding to subsequent four horizontal synchronizing periods, and the inverted gate clocks CK1B to CK4B are given. The gate clocks CK1 to CK4 are a four-phase signal in which phases are shifted by a length corresponding to one horizontal synchronizing period as illustrated in FIG. 6, which will be described below, and the inverted gate clocks CK1B to CK4B are logical inversion signals thereof. Note that, the horizontal synchronizing period here means a period during which one row in a display screen is selected. Moreover, the length of the precharging period is not limited to the length corresponding to three horizontal synchronizing periods, and may be a length corresponding to one or two horizontal synchronizing periods, or may be a length corresponding to a predetermined number of horizontal synchronizing periods, which is four or more.

The shift registers 401 to 404 sequentially outputs scanning signals G(1) to G(n) which are obtained by shifting the received gate start pulse signals GSP based on the corresponding gate clocks CK1 to CK4 and inverted gate clocks CK1B to CK4B. Only in a case where the corresponding one of the row selection enable signals EN1 to EN4 is active, each of the AND circuits 411 outputs the corresponding one of the scanning signals G(1) to G(n). For example, an AND circuit 411 illustrated in FIG. 3 outputs the scanning signal G(1) only in a case where the row selection enable signal EN1 and the scanning signal G(1) are input and the row selection enable signal EN1 is active.

Note that, it is preferable that the scanning signal line driving circuit 400 as above is formed on a substrate integrally (that is, so as to be monolithic) with the TFT of each pixel forming part P(n, m) which is included in the display portion 500 and wires. This makes it possible to reduce an area occupied by a frame region compared with a case where the scanning signal line driving circuit 400 is configured by an IC chip or the like and mounted on a frame of the substrate, so that it is possible to achieve frame narrowing of a display panel.

In this manner, the video signals for driving are applied to the respective video signal lines SL(1) to SL(M), and the scanning signals are applied to the respective scanning signal lines GL(1) to GL(N), and thereby an image is displayed on the display portion 500.

<1.2 Configuration and Operation of Display Control Circuit>

Figure 4:
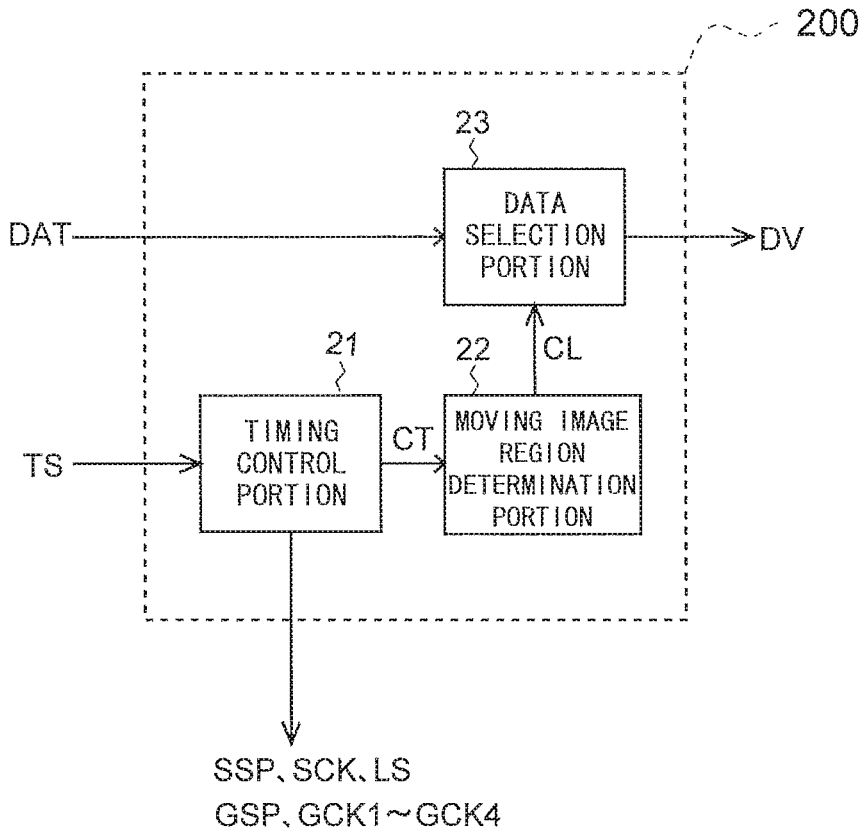
FIG. 4 is a block diagram illustrating a detailed configuration of a display control circuit in the embodiment.

FIG. 4 is a block diagram illustrating a configuration of the display control circuit 200 in the present embodiment. The display control circuit 200 includes a timing control portion 21 which performs timing control, a moving image region determination portion 22 which determines a moving image region based on a control signal from the timing control portion 21 and a moving image region instruction signal which is supplied from an outside of the device and not illustrated, and a data selection portion 23 which receives a pixel value (display gradation data) included in the display data signal DAT which is supplied from the outside of the device, and, based on a control signal from the moving image region determination portion 22, outputs the received pixel value as it is as to a part corresponding to the moving image region and outputs the received pixel value only for one frame period of sixty frame periods as to the other part corresponding to a still image region.

The timing control portion 21 receives the timing control signal TS which is transmitted from the outside, and outputs a control signal CT which is for controlling an operation of the moving image region determination portion 22, and the source start pulse signal SSP, the source clock signal SCK, the latch strobe signal LS, the gate start pulse signals GSP, and the gate clock signals GCK1 to GCK4, which are for controlling the timing of displaying an image on the display portion 500.

The moving image region determination portion 22 determines a row for which normal moving image display is performed on the display portion 500 and a row for which a still image display, by which partial pause drive is performed, is performed, based on the moving image region instruction signal which is supplied from the outside of the device and not illustrated and the control signal CT which is received from the timing control portion 21.

Figure 5:
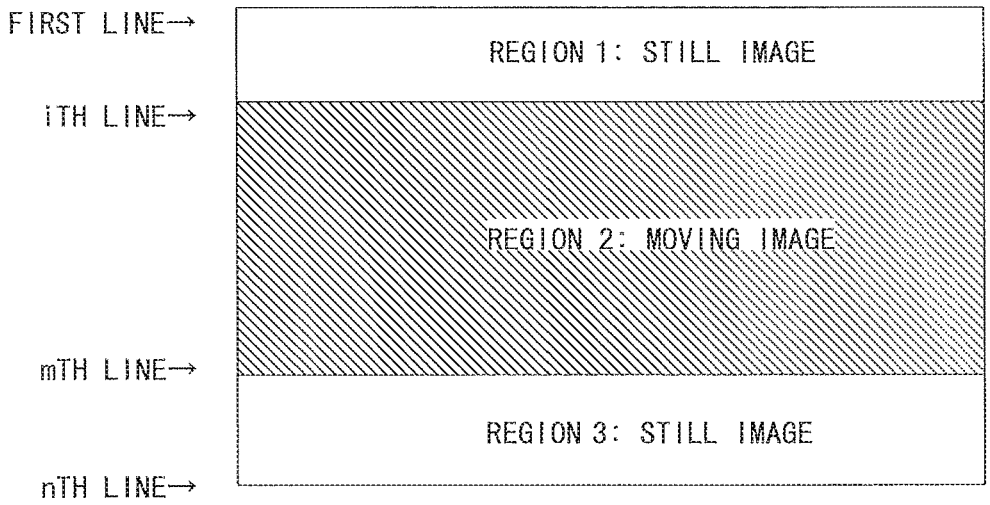
FIG. 5 is a view illustrating a moving image region and still image regions in the embodiment.

FIG. 5 is a view illustrating a moving image region and still image regions which are indicated with the moving image region instruction signal. In the figure, the display portion 500 is divided into three regions. A region 1 which is from a first row to an (i−1)th row and a region 3 which is from an (m+1)th row to an nth row are the still image regions, and a region 2 which is from an ith row to an mth row is the moving image region. The moving image region instruction signal includes values of i and m and indicates a starting row i and a finishing row m of the moving image region, for example. Partial pause drive by which rewriting is performed only once in sixty frame periods is performed in the still image regions, and normal drive by which rewriting is performed for each frame period is performed in the moving image region. Accordingly, it can be said that the normal drive has a refresh frequency of 60 Hz, but is equivalent to the pause drive with 1 Hz when focusing only on the still image regions.

The moving image region determination portion 22 outputs a control signal CL with which the data selection portion 23 is controlled so that data of all rows is output so as to rewrite all the rows, for example, in a first frame period and data only from the ith row to the mth row is output, for example, from a second frame period to a sixtieth frame period.

The data selection portion 23 receives the display data signal DAT which is transmitted from the outside, and outputs data whose frequency to be output is different between the moving image region and the still image regions to the video signal line driving circuit 300 as the digital image signals DV based on the control signal CL from the moving image region determination portion 22.

Figure 7:
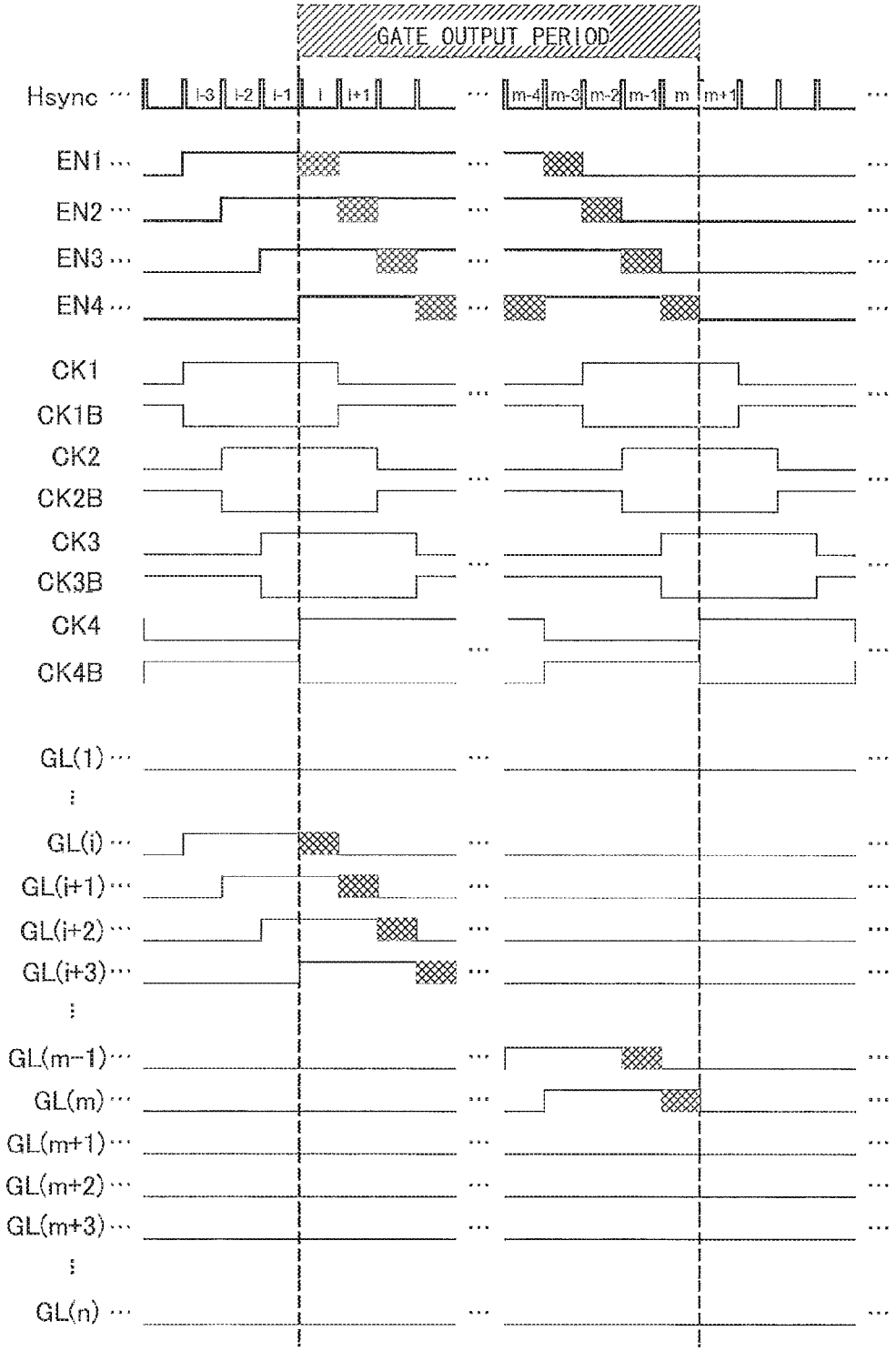
FIG. 7 is a waveform chart of various signals of second to sixtieth frames, during which only the moving image region is rewritten, in the embodiment.

Next, a method of driving the liquid crystal display device according to the present embodiment, which is for displaying the digital image signals DV on the display portion 500, will be described with reference to FIG. 6 and FIG. 7. FIG. 6 is a waveform chart of various signals of a first frame during which a whole screen is rewritten, and FIG. 7 is a waveform chart of various signals of second to sixtieth frames during which only the moving image region is rewritten.

As can be seen from FIG. 6, the row selection enable signals EN1 to EN4 are always at H level (here, a VDD level) in all horizontal synchronizing periods Hsync1 to Hsyncn, and all the rows are selected. That is, the gate clocks CK1 to CK4 and the inverted gate clocks CK1B to CK4B are always selected by the corresponding row selection enable signals EN1 to EN4, resulting in that the scanning signals G(1) to G(n) are output to the scanning signal lines GL(1) to GL(n) based on the gate clocks CK1 to CK4. Note that, since the scanning signal lines GL(1) to GL(n) transmit the scanning signals G(1) to G(n), potentials of the scanning signal lines GL(1) to GL(n) are also referred to as scanning signal line potentials GL(1) to GL(n) below.

In addition, parts of the row selection enable signals EN1 to EN4 and the scanning signal line potentials GL(1) to GL(n) in the figure, in which cross hatching is provided, indicate the above-described main charging periods during which the video signals for driving are written in the pixel capacitors, and the other corresponding parts indicate the precharging periods (preliminary charging periods).

In the present embodiment, it is configured that the video signals for driving which are to be supplied in preceding three rows are supplied as precharge signals in the precharging period, but the video signal line driving circuit 300 may have a configuration in which a precharge signal having a predetermined potential is output. In this case, by setting, for example, a first half of the selected periods as the precharging period and a latter half as the main charging period, the precharge signal may be output in the precharging period and the video signals for driving may be output in the main charging period.

After the whole screen is rewritten in the above-described manner, in the still image regions, a potential of a pixel capacitor is maintained as it is, and no scanning signal is supplied during a period from the second frame to the sixtieth frame. In the moving image region, an image is rewritten for each frame. Accordingly, as indicated in FIG. 7, the row selection enable signals EN1 to EN4 become at the H level so that the main charging periods are provided in a range from the ith row to the mth row, which corresponds to the moving image region, and the precharging periods corresponding to the main charging periods are also provided, and thereby the scanning signals including the main charging periods and the precharging periods are supplied to the scanning signal lines GL(i) to GL(m).

Here, in a case where the row selection enable signals EN1 to EN4 as in the present embodiment do not exist and only one row selection enable signal EN exists as in a conventional example, display of a moving image region becomes abnormal in some cases. Hereinafter, this display abnormality will be described with reference to FIG. 8.

Figure 8:
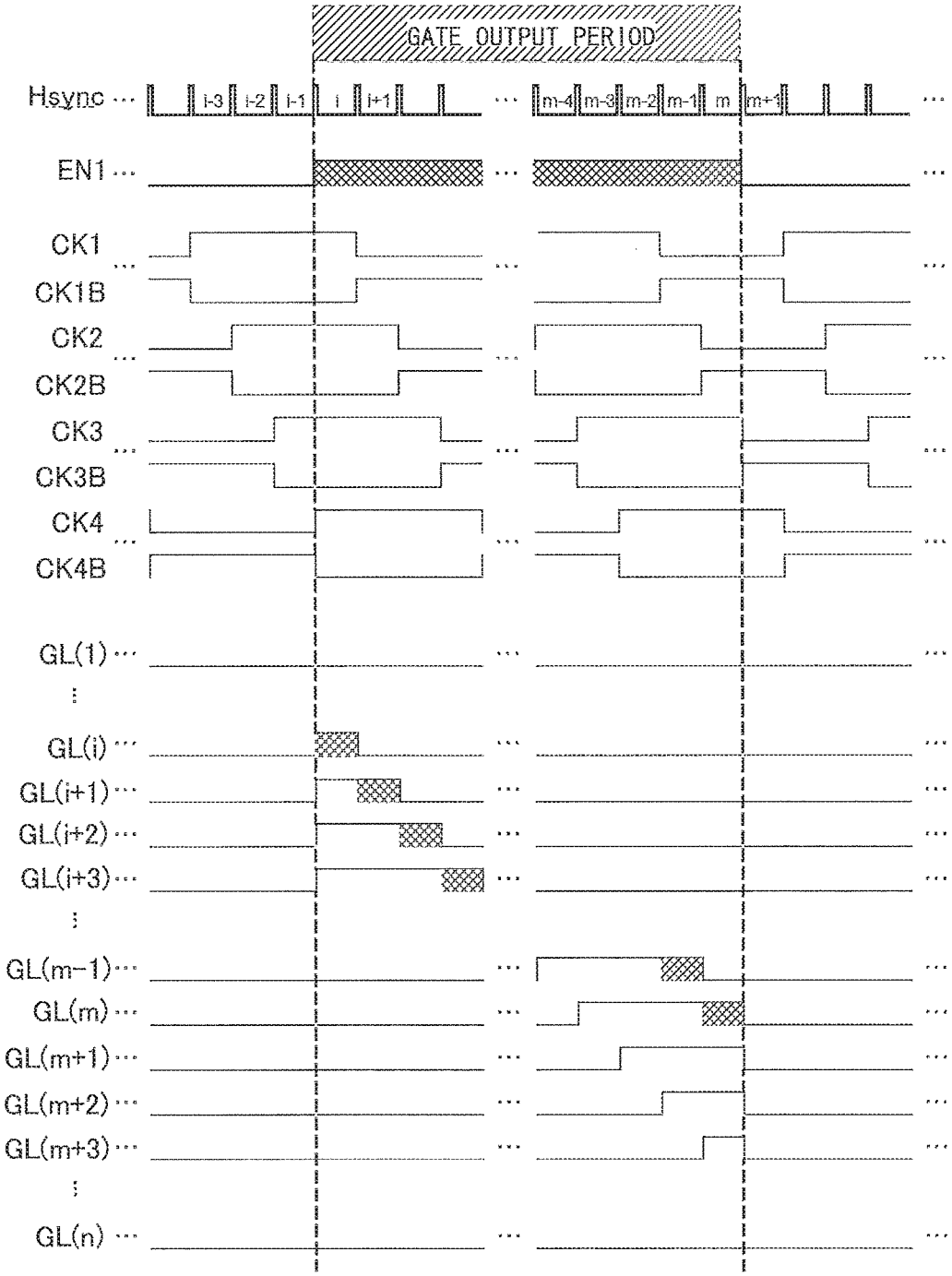
FIG. 8 is a waveform chart of various signals in a case where there is one row selection enable signal EN in the embodiment.

FIG. 8 is a waveform chart of various signals in a case where there is one row selection enable signal EN in the configuration of the present embodiment. As can be seen from FIG. 8, since the row selection enable signal EN is at the H level during horizontal synchronizing periods corresponding to the range from the ith row to the mth row, which corresponds to the moving image region, the gate clocks CK1 to CK4 and the inverted gate clocks CK1B to CK4B are selected, and the scanning signal line potentials GL(i) to GL(n) are at the H level (active) in the range. However, the scanning signal line potential GL(i) includes only a range of the H level, which corresponds to a main charging period, and does not have a precharging period. Moreover, precharging periods of the scanning signal line potentials GL(i+1) and GL(i+2) are short. Thus, in the main charging periods corresponding thereto, sufficient charging is not performed due to lack of the precharging periods, resulting in that pixel gradation becomes abnormal (that is, becomes brighter or darker than predetermined gradation) in some cases.

Moreover, each of scanning signal line potentials GL(m+1) to GL(m+3) includes no main charging period, but includes a range of the H level corresponding to an unnecessary precharging period. As a result thereof, display abnormality such that pixel gradation which is not visible originally is visible as noise is caused in some cases.

In this manner, in the case where there is only one row selection enable signal EN, display abnormality may be caused in a moving image region which is in a vicinity of a boundary with a still image region in some cases, so that display quality is deteriorated. However, in the present embodiment, a precharging period having a necessary length is always set with respect to a scanning signal line corresponding to a moving image region, and no unnecessary precharging period is set at all. Thus, differently from the case indicated in FIG. 8, display quality is not deteriorated.

In addition, in the present embodiment, waveform patterns of the row selection enable signals EN1 to EN4 merely need to have eight patterns in total, which are composed of four patterns of rising time and four patterns of falling time, regardless of positions of a starting row and finishing row of a moving image region, so that it is possible to store the waveform patterns with a small storage capacity, and to perform control simply. Hereinafter, description will be given with reference to FIG. 9 to FIG. 13.

FIG. 9 is a view illustrating a relation between rising time of the row selection enable signals EN1 to EN4 and a starting position of the moving image region. Four numbers of 4k+1, 4k+2, 4k+3, and 4k (k is a natural number) which are indicated in FIG. 9 indicate to which of the four patterns the starting row i of the moving image region corresponds, and the four patterns are indicated in the table so as to indicate to which horizontal synchronizing period Hsync (that is, to which row) rising time points of the row selection enable signals EN1 to EN4 corresponding to the respective patterns correspond.

That is, each of the rising time points of the row selection enable signals EN1 to EN4 is able to be classified into four patterns, which are indicated in FIG. 9, in accordance with a value of a remainder when the starting row i is divided by 4. For example, when i is a multiple of 4, i is 4k, so that the rising time points of the row selection enable signals EN1 to EN4 in the right end of the table are read (from a predetermined storage portion) and determined.

More specifically, in a case where the starting row i of the moving image region is a ninth row, i is 4k+1, so that the rising time points of the row selection enable signals EN1 to EN4 in the left end of the table are read, and, by the display control circuit 200, the rising time point of the row selection enable signal EN1 is set as a sixth (=9−3) row, the rising time point of the row selection enable signal EN2 is set as a seventh (=9−2) row, and furthermore, the rising time points of the row selection enable signals EN3 and EN4 are set as an eighth row and the ninth row, respectively.

In this manner, the four row selection enable signals store the four rising patterns therein in advance, and the display control circuit 200 sets the rising time points thereof in one of the patterns in accordance with the starting row of the moving image region. Note that, FIG. 9 is merely an example which indicates a content to be stored, and storing may be performed in this manner. For example, which of the row selection enable signals EN1 to EN4 a row selection enable signal to rise at the ith row is may be stored.

Figure 10:
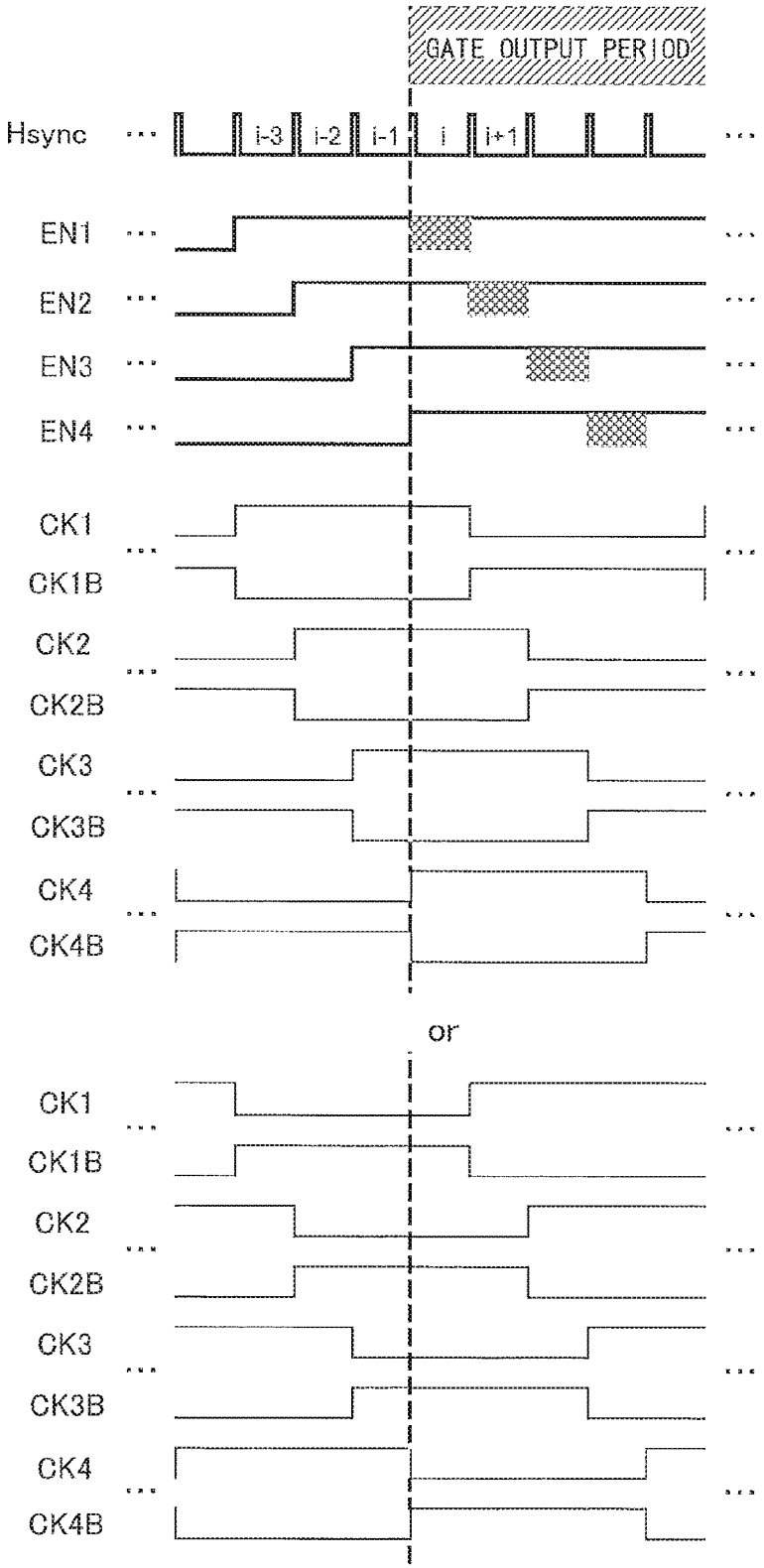
FIG. 10 is a waveform chart of row selection enable signals, a clock signal, and the like in the case of i=4k+1, in the embodiment.
Figure 11:
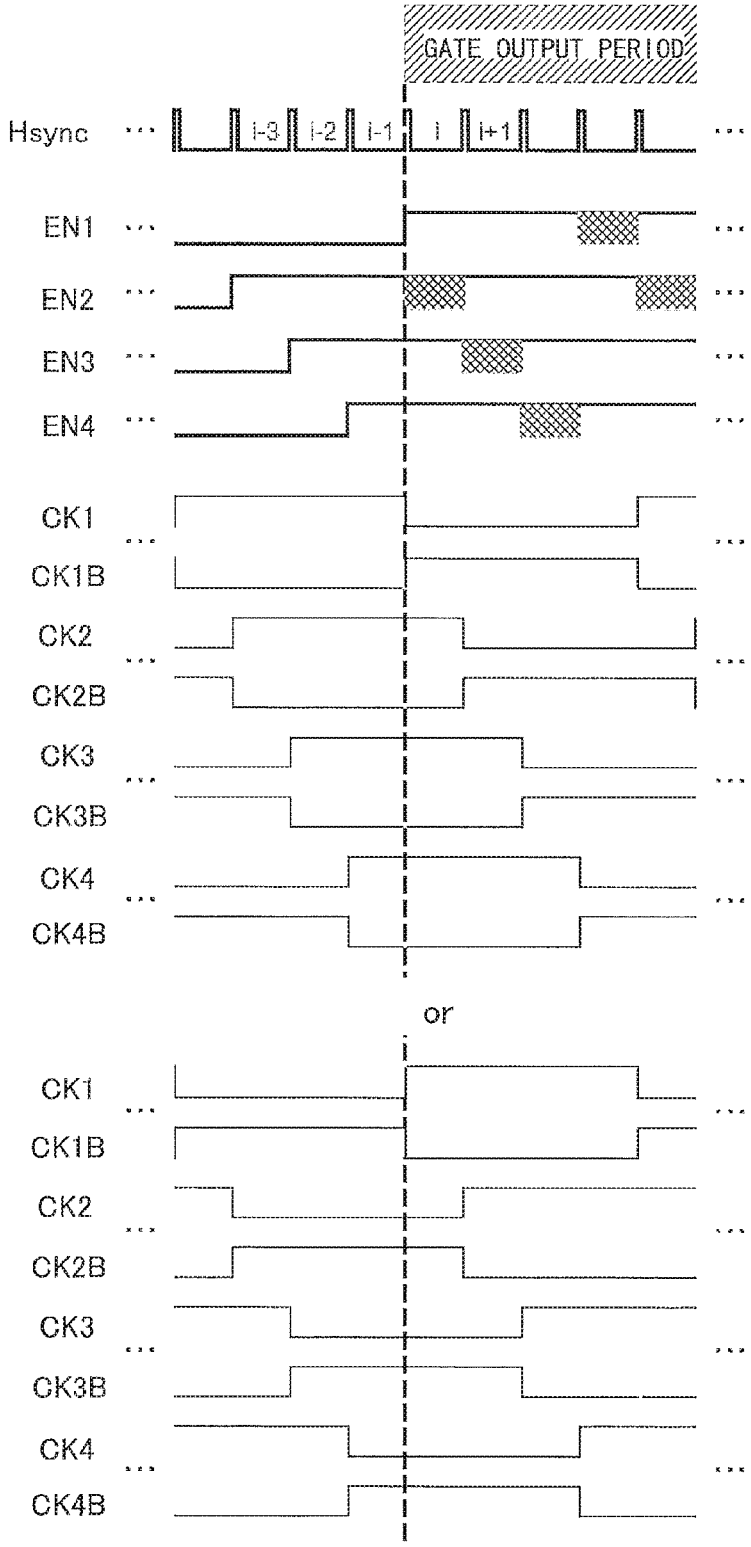
FIG. 11 is a waveform chart of the row selection enable signals, the clock signal, and the like in the case of i=4k+2, in the embodiment.
Figure 12:
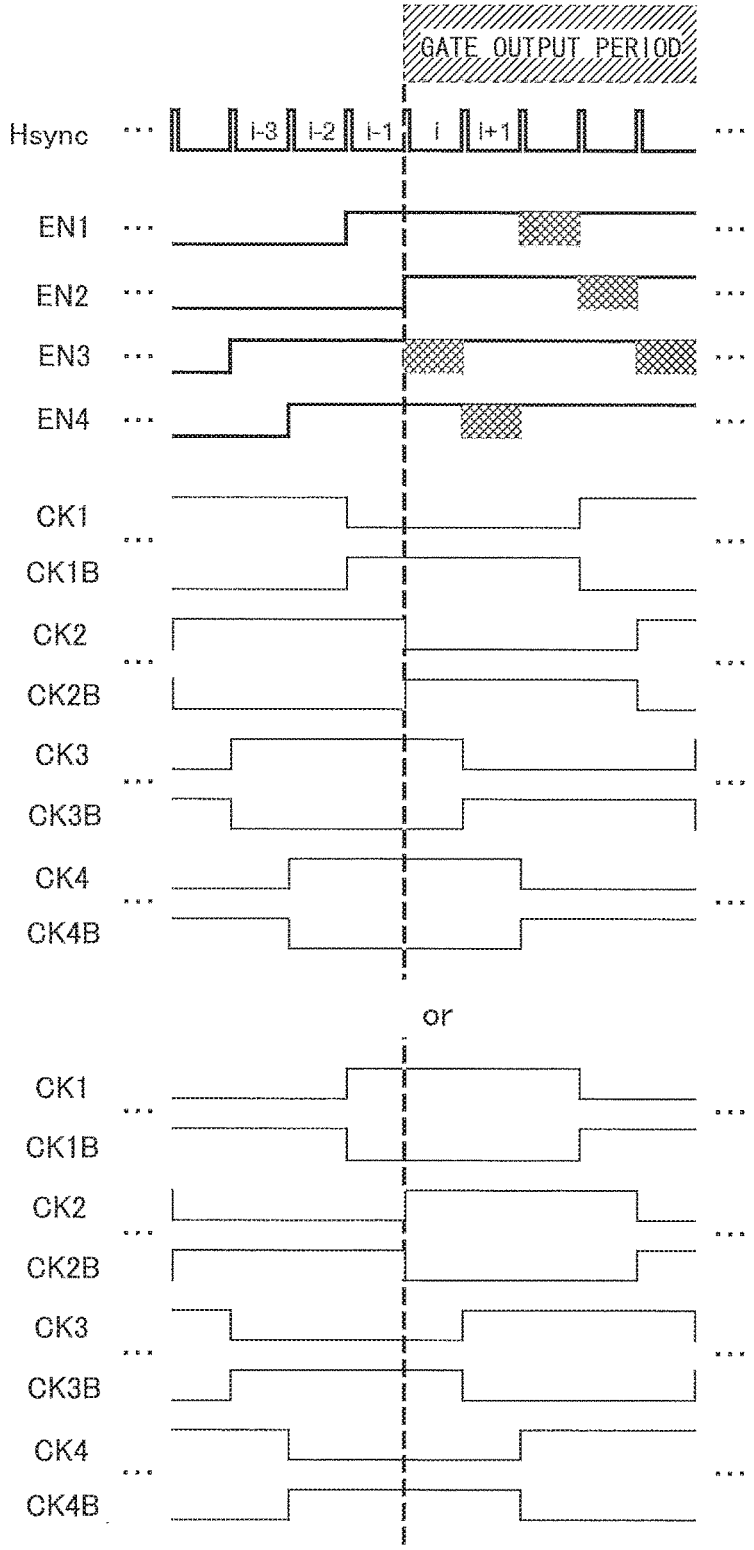
FIG. 12 is a waveform chart of the row selection enable signals, the clock signal, and the like in the case of i=4k+3, in the embodiment.
Figure 13:
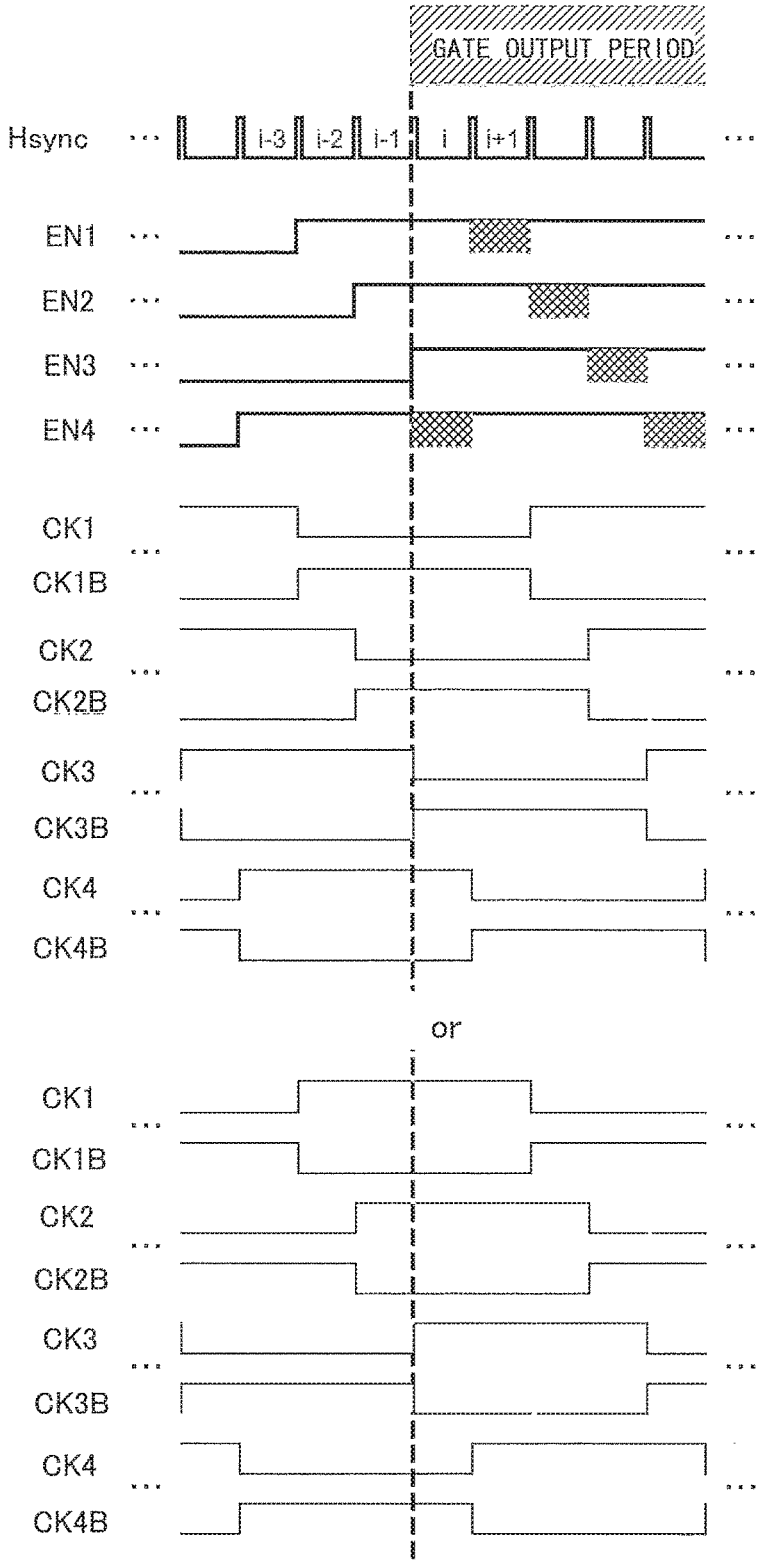
FIG. 13 is a waveform chart of the row selection enable signals, the clock signal, and the like in the case of i=4k, in the embodiment.

FIG. 10 to FIG. 13 indicate waveforms of the row selection enable signals EN1 to EN4 for which the rising time points indicated in FIG. 9 are set, and the gate clocks CK1 to CK4 and the inverted gate clocks CK1B to CK4B (hereinafter, also referred to as a clock signal and the like). That is, FIG. 10 is a waveform chart of the row selection enable signals and the clock signal and the like in the case of i=4k+1, FIG. 11 is a waveform chart of the row selection enable signals and the clock signal and the like in the case of i=4k+2, FIG. 12 is a waveform chart of the row selection enable signals and the clock signal and the like in the case of i=4k+3, and FIG. 13 is a waveform chart of the row selection enable signals and the clock signal and the like in the case of i=4k.

Note that, letters of "or" indicated in these figures indicate that clock signal and the like indicated below are those of another example. That is, in a waveform chart of the clock signal indicated below "or" in each of the figures, the gate clocks and the inverted gate clocks are switched, as can be seen from comparison with each waveform chart of the clock signal indicated thereabove. Accordingly, either in each figure may be suitably adopted in accordance with which of the gate clocks and the inverted gate clocks are set as a reference.

Next, falling time points of the row selection enable signals EN1 to EN4 are also able to be calculated similarly to the rising time points described above. FIG. 14 is a view illustrating a relation between falling time of the row selection enable signals EN1 to EN4 and a finishing position of the moving image region. Similarly to the case of FIG. 9, four numbers of 4k+1 to 4k (k is a natural number) which are indicated in FIG. 14 indicate to which of the four patterns the finishing row m of the moving image region corresponds, and the four patterns are indicated in the table so as to indicate to which horizontal synchronizing period Hsync (that is, to which row) the falling time points of the row selection enable signals EN1 to EN4 corresponding to the respective patterns correspond.

That is, similarly to the case of FIG. 9, each of the falling time points of the row selection enable signals EN1 to EN4 is able to be classified into the four patterns, which are indicated in FIG. 14, in accordance with a value of a remainder when the finishing row m is divided by 4. In this manner, similarly to the four rising patterns, the four row selection enable signals EN1 to EN4 store the four falling patterns therein in advance, one of the patterns is selected in accordance with the finishing row m of the moving image region, and the display control circuit 200 sets falling time points.

Figure 15:
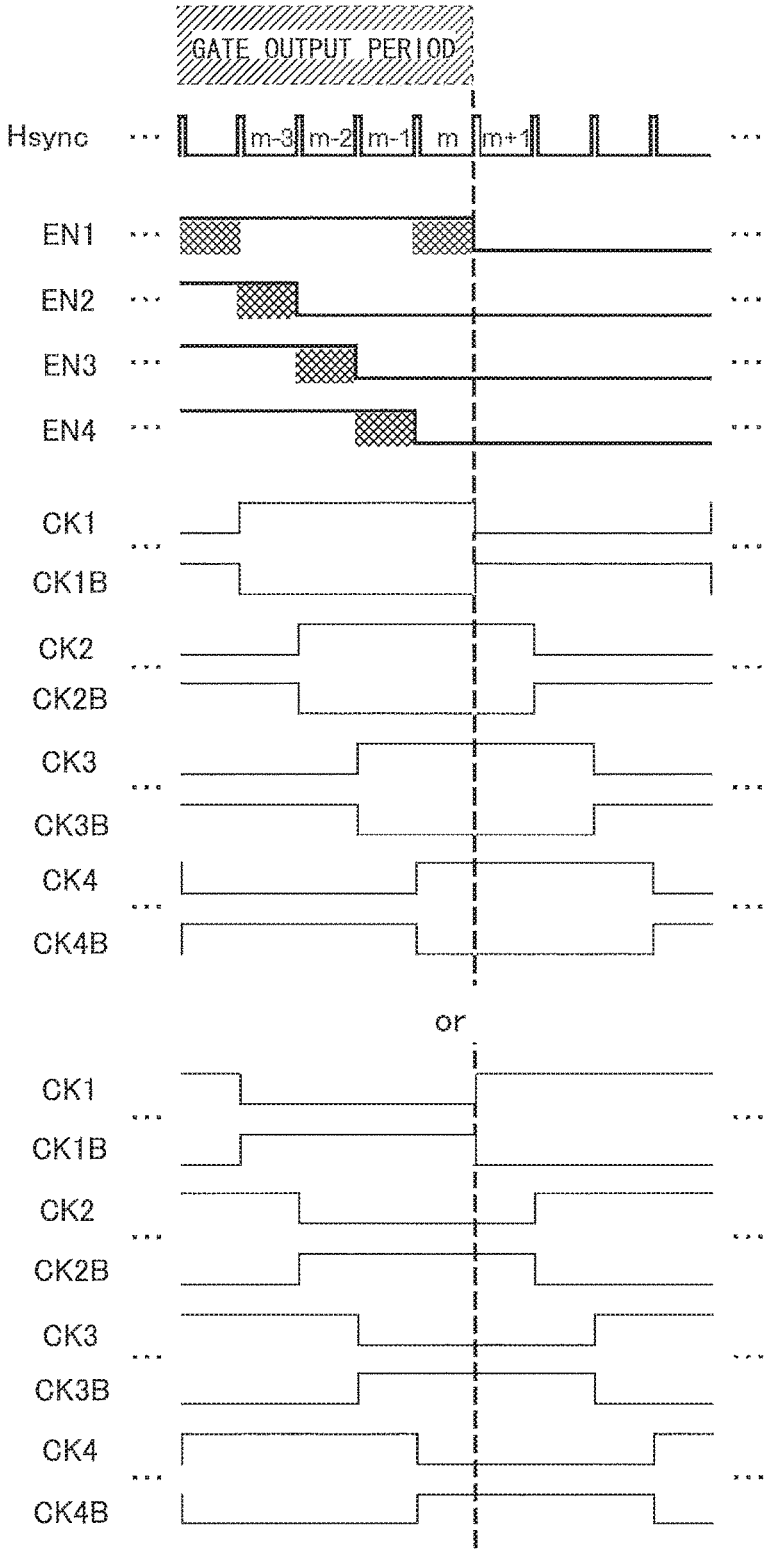
FIG. 15 is a waveform chart of the row selection enable signals, the clock signal, and the like in the case of m=4k+1, in the embodiment.
Figure 16:
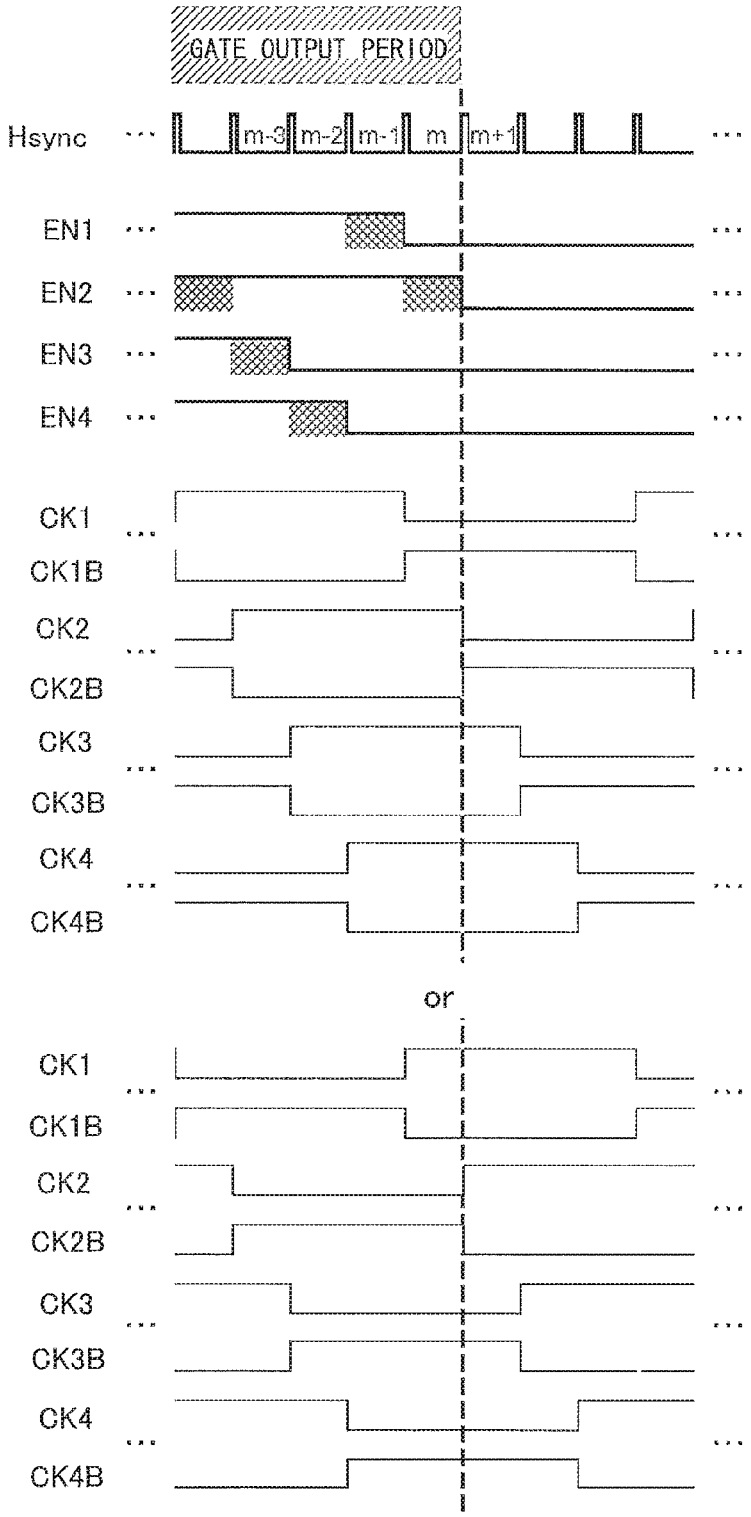
FIG. 16 is a waveform chart of the row selection enable signals, the clock signal, and the like in the case of m=4k+2, in the embodiment.
Figure 17:
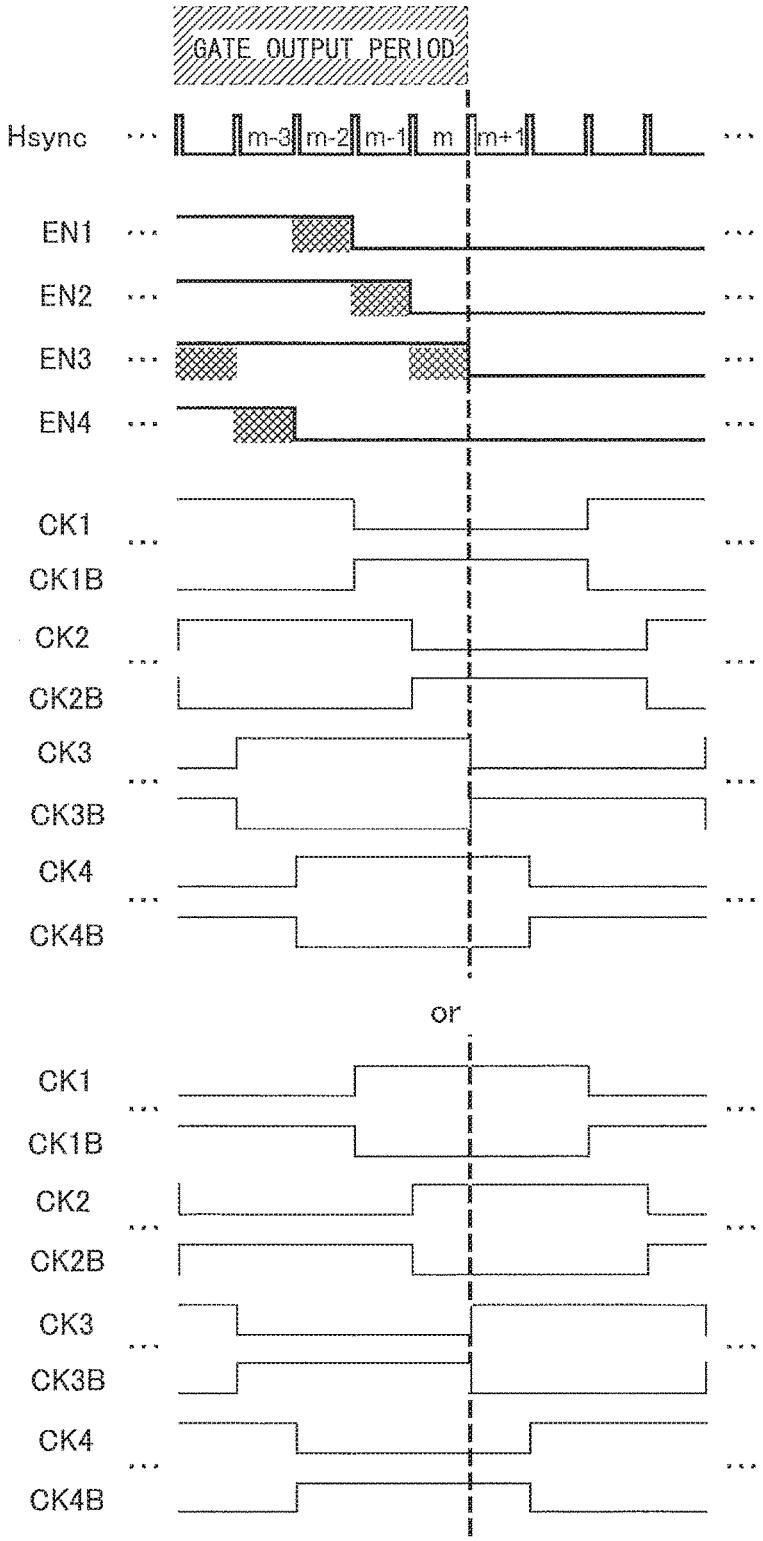
FIG. 17 is a waveform chart of the row selection enable signals, the clock signal, and the like in the case of m=4k+3, in the embodiment.
Figure 18:
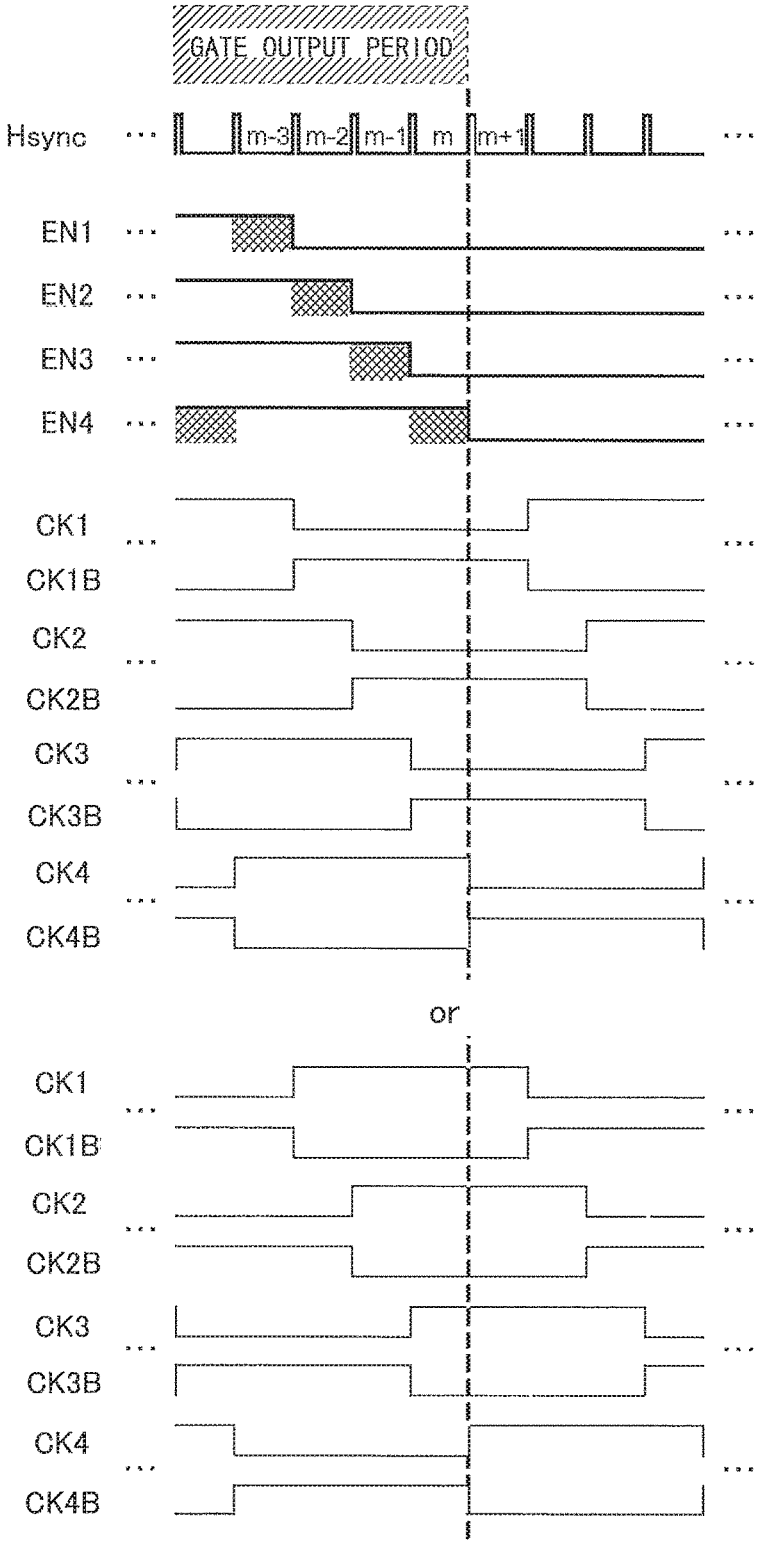
FIG. 18 is a waveform chart of the row selection enable signals, the clock signal, and the like in the case of m=4k, in the embodiment.

FIG. 15 to FIG. 18 indicate waveforms of the row selection enable signals EN1 to EN4 for which the falling time points indicated in FIG. 14 are set, and the gate clocks CK1 to CK4 and the inverted gate clocks CK1B to CK4B. That is, FIG. 15 is a waveform chart of the row selection enable signals and the clock signal and the like in the case of m=4k+1, FIG. 16 is a waveform chart of the row selection enable signals and the clock signal and the like in the case of m=4k+2, FIG. 17 is a waveform chart of the row selection enable signals and the clock signal and the like in the case of m=4k+3, and FIG. 18 is a waveform chart of the row selection enable signals and the clock signal and the like in the case of m=4k. Note that, since letters of "or" indicated in these figures are similar to those of FIG. 10 to FIG. 13, description thereof will be omitted.

As above, the four row selection enable signals EN1 to EN4 stores therein eight patterns in total, which are composed of the four rising patterns and the four falling patterns, in advance, so that it is possible to easily realize partial display only by selecting one of the patterns in accordance with the starting row i and the finishing row m of the moving image region and setting the rising time points and the falling time points. In addition, it is possible to reduce a region in which the patterns are stored.

Figure 19:
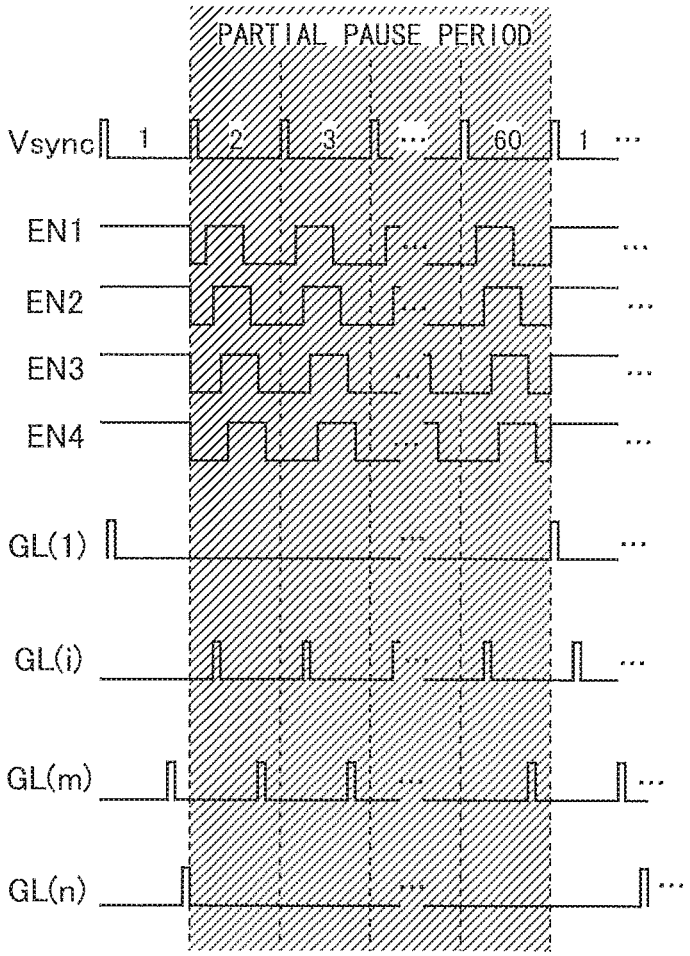
FIG. 19 is a waveform chart of various signals for performing partial display in the first to sixtieth frame periods in the embodiment.

FIG. 19 is a waveform chart of various signals for performing partial display in the first to sixtieth frame periods. As described above, the partial display is realized by performing partial pause drive, by which rewriting is performed only once during sixty frame periods, in the still image regions illustrated in FIG. 5, and by performing normal drive, by which rewriting is performed for each frame period, in the moving image region. Accordingly, as illustrated in FIG. 19, since the row selection enable signals EN1 to EN4 are always active in a vertical synchronizing period Vsync1 which indicates the first frame, a scanning signal including a main selection period is supplied to each of all the scanning signal lines GL(1) to GL(n). Thereafter, from the second frame to the sixtieth frame, a partial pause period, in which only the moving image region is refreshed, is set as illustrated in FIG. 19, and the row selection enable signals EN1 to EN4 become active only during a period for performing display in the moving image region, so that the scanning signals are supplied only to the scanning signal lines GL(i) to GL(m) and no scanning signal is supplied to the other scanning signal lines. The display control circuit 200 outputs the row selection enable signals as described above and outputs the scanning signals as described above to the scanning signal line driving circuit 400, and thereby realizes the partial display.

<1.4 Effect of First Embodiment>

As above, in the present embodiment, differently from the case where there is only one row selection enable signal EN, since a precharging period having a necessary length is always set with respect to a scanning signal line corresponding to a moving image region, and no unnecessary precharging period is set at all, abnormality of display gradation due to lack of the precharging period or display of noise due to addition of an unnecessary precharging period is not caused, so that it is possible to prevent display quality from being deteriorated.

Moreover, with the configuration in which eight patterns of the row selection enable signals in total, which are composed of four rising patterns and four falling patterns, are stored in advance, one of the patterns may be selected in accordance with a starting row and a finishing row of a moving image region and rising time points and falling time points may be set. Thus, it is possible to realize partial display with a simple configuration, and to reduce a region in which the patterns are stored.

2. Second Embodiment

<2.1 Entire Configuration and Operation of Liquid Crystal Display Device>

An entire configuration of a liquid crystal display device of an active matrix type according to a second embodiment of the invention is similar to that of the case of the first embodiment, and an equivalent circuit (refer to FIG. 2) of the pixel forming part P(n, m), a configuration of the scanning signal line driving circuit 400 (refer to FIG. 3), and the like in the display portion 500 are also similarly configured, so that description thereof will be omitted.

Figure 20:
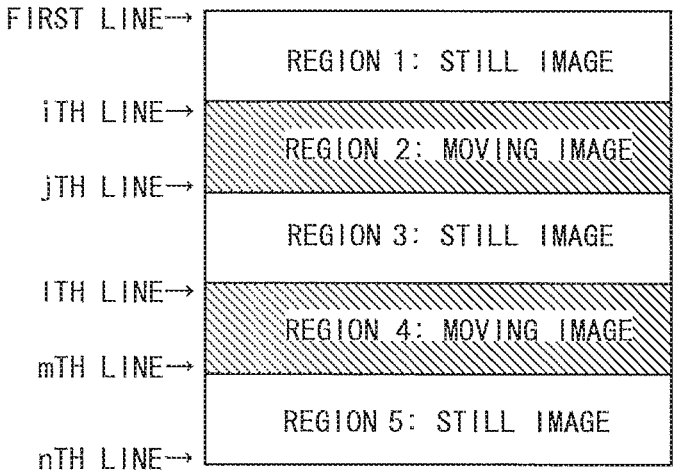
FIG. 20 is a view illustrating moving image regions and still image regions in a second embodiment of the invention.

Differently from the case of the first embodiment, two moving image regions and three still image regions are provided in the present embodiment. FIG. 20 is a view illustrating the moving image regions and the still image regions in the present embodiment. In the figure, the display portion 500 is divided into five regions. A region 1 which is from a first row to an (i−1)th row, a region 3 which is from a (j+1)th row to an (1-1)th row, and a region 5 which is from an (m+1)th row to an nth row are the still image regions, and a region 2 which is from an ith row to a jth row and a region 4 which is from an lth row to an mth row are the moving image regions. Similarly to the case of the first embodiment, partial pause drive by which rewriting is performed only once in sixty frame periods is performed in the still image regions, and normal drive by which rewriting is performed for each frame period is performed in the moving image regions.

In order to realize such partial display, differently from the case of the first embodiment, in the present embodiment, eight row selection enable signals are provided in total by providing four of them to each of the moving image regions. Hereinafter, an operation of the display control circuit 200 will be described specifically with reference to FIG. 21 and FIG. 22.

<2.2 Operation of Display Control Circuit>

Figure 21:
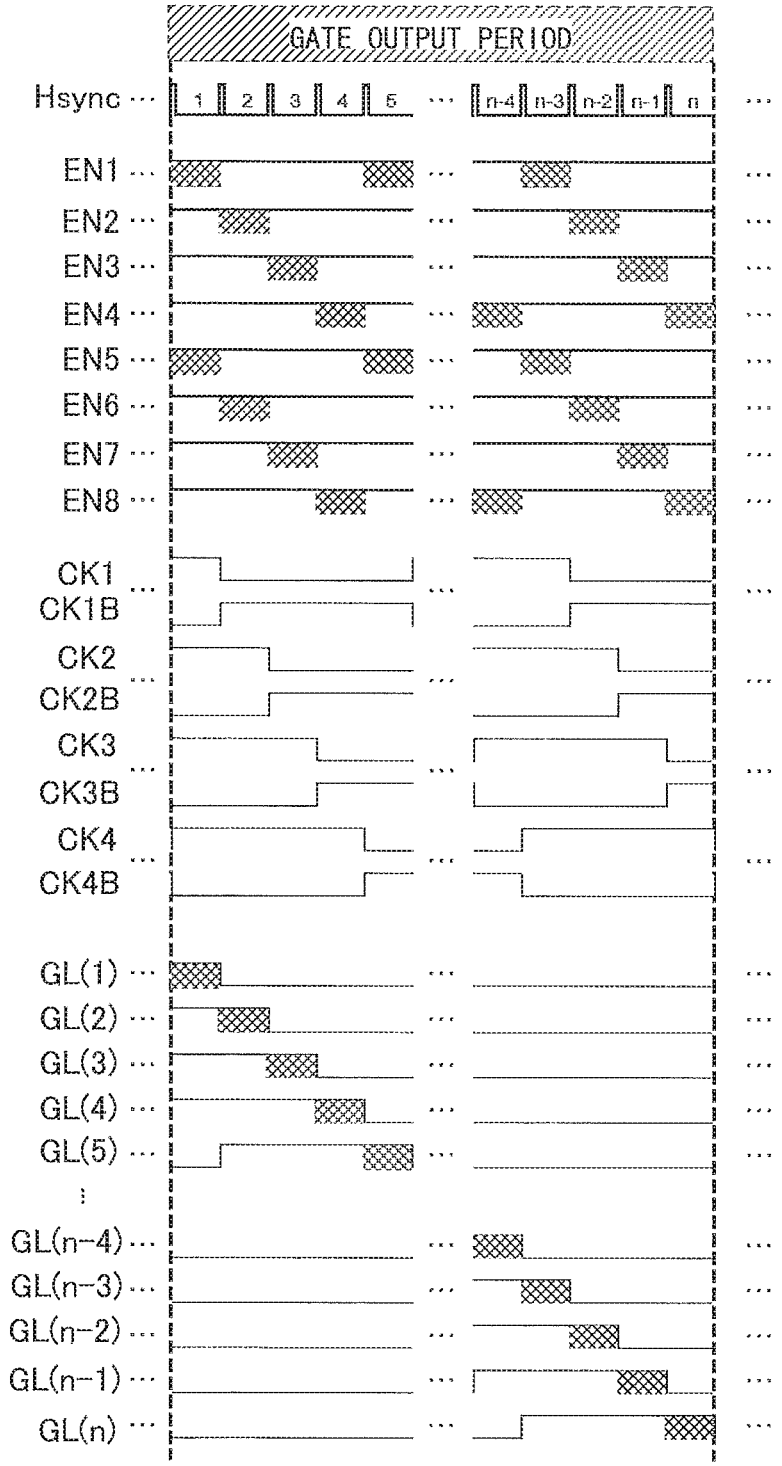
FIG. 21 is a waveform chart of various signals of a first frame, during which a whole screen is rewritten, in the embodiment.
Figure 22:
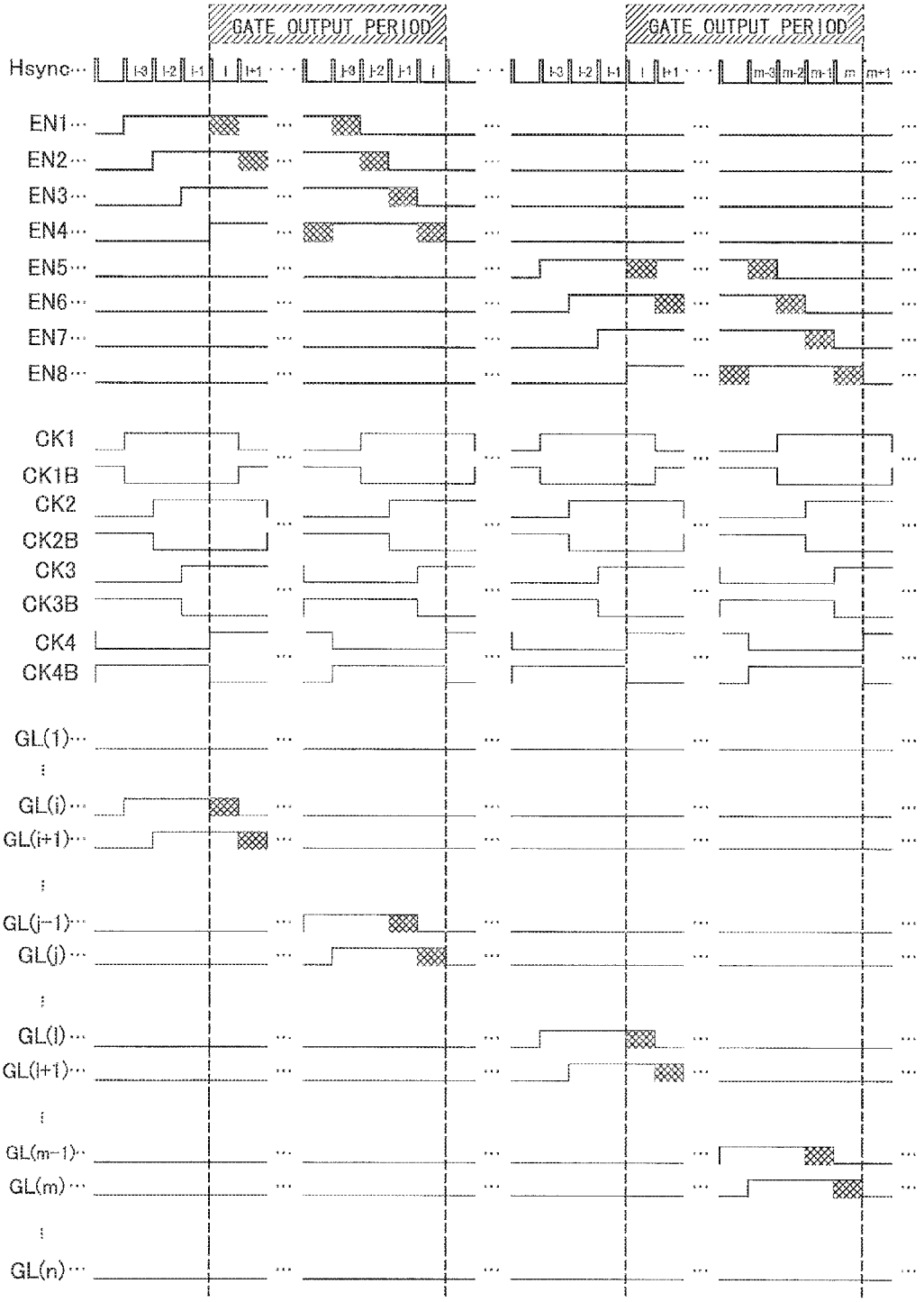
FIG. 22 is a waveform chart of various signals of second to sixtieth frames, during which only the moving image regions are rewritten, in the embodiment.

FIG. 21 is a waveform chart of various signals of a first frame during which a whole screen is rewritten, and FIG. 22 is a waveform chart of various signals of second to sixtieth frames during which only the moving image regions are rewritten. Similarly to the case of the first embodiment, which is indicated in FIG. 6, as can be seen from FIG. 21, row selection enable signals EN1 to EN8 are always at the H level (here, the VDD level) in all horizontal synchronizing periods Hsync1 to Hsyncn, and all rows are selected. That is, the gate clocks CK1 to CK4 and the inverted gate clocks CK1B to CK4B are always selected by the corresponding row selection enable signals EN1 to EN8, resulting in that the scanning signals G(1) to G(n) are output to the scanning signal lines GL(1) to GL(n) based on the gate clocks CK1 to CK4.

After the whole screen is rewritten in the above-described manner, in the still image regions, a potential of a pixel capacitor is maintained as it is, and no scanning signal is supplied during a period from the second frame to the sixtieth frame. In the moving image regions, an image is rewritten for each frame. Accordingly, as indicated in FIG. 22, the row selection enable signals EN1 to EN4 become at the H level so that main charging periods are provided in a range from the ith row to the jth row, which corresponds to the moving image region, and precharging periods corresponding to the main charging periods are also provided, and the row selection enable signals EN5 to EN8 become at the H level so that main charging periods are provided in a range from the lth row to the mth row, which corresponds to the next moving image region, and precharging periods corresponding to the main charging periods are also provided, and thereby scanning signals including the main charging periods and the precharging periods are supplied to the scanning signal lines GL(i) to GL(m).

In addition, similarly to the first embodiment, in the present embodiment, waveform patterns of the row selection enable signals EN1 to EN8 merely need to have eight patterns in total, which are composed of four patterns of rising time and four patterns of falling time, regardless of positions of starting rows and finishing rows of the moving image regions, so that it is possible to store the waveform patterns with a small storage capacity, and to perform control simply. Accordingly, it is possible to easily realize partial display only by selecting one of the patterns in accordance with each of the starting rows and each of the finishing rows of the moving image regions and setting rising time points and falling time points thereof. In addition, it is possible to reduce a region in which the patterns are stored.

Figure 23:
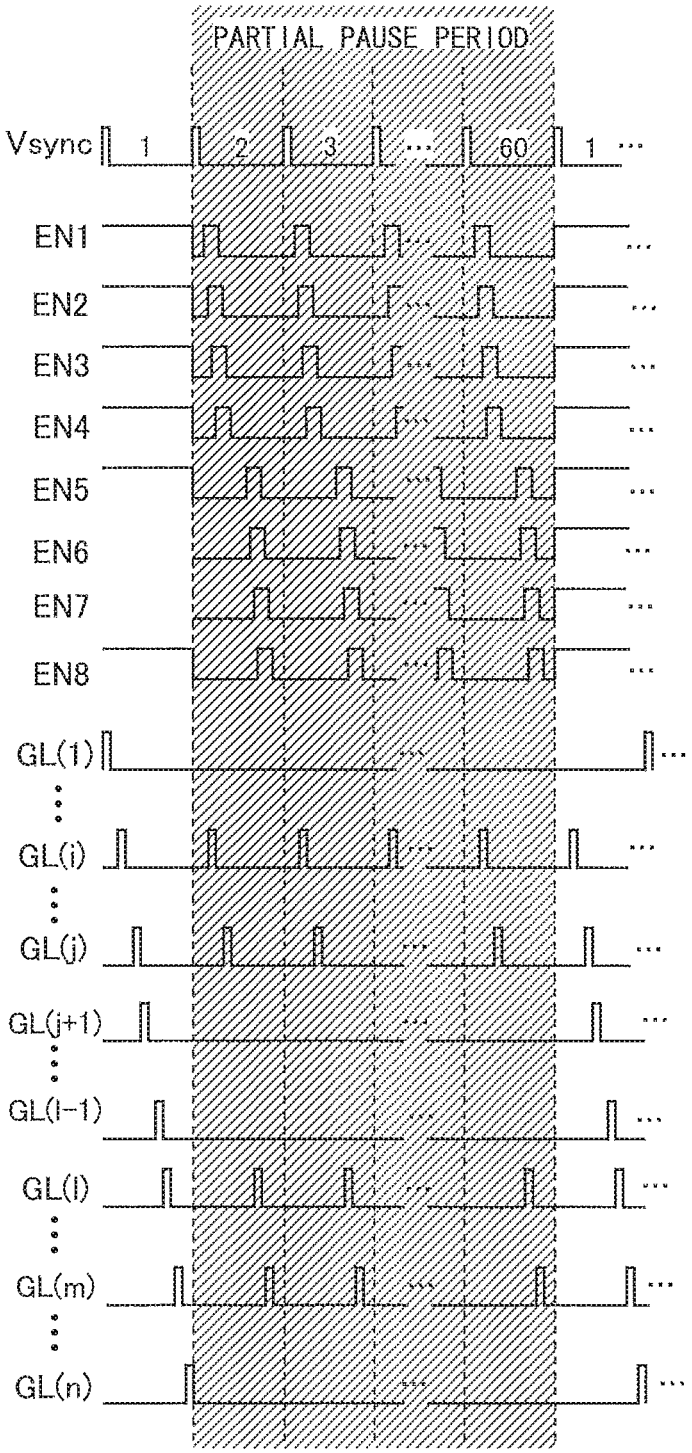
FIG. 23 is a waveform chart of various signals for performing partial display in the first to sixtieth frame periods in the embodiment.

FIG. 23 is a waveform chart of various signals for performing partial display in the first to sixtieth frame periods. As described above, the partial display is realized by performing partial pause drive, by which rewriting is performed only once during sixty frame periods, in the still image regions illustrated in FIG. 20, and by performing normal drive, by which rewriting is performed for each frame period, in the moving image regions. Accordingly, as illustrated in FIG. 23, since the row selection enable signals EN1 to EN8 are always active in a vertical synchronizing period Vsync1 which indicates the first frame, a scanning signal including a main selection period is supplied to each of all the scanning signal lines GL(1) to GL(n). Thereafter, from the second frame to the sixtieth frame, a partial pause period, in which only the moving image regions are refreshed, is set as illustrated in FIG. 23, and the row selection enable signals EN1 to EN8 become active only during a period for performing display in the moving image regions, so that the scanning signals are supplied only to the scanning signal lines GL(i) to GL(j) and GL(1) to GL(m) and no scanning signal is supplied to the other scanning signal lines. The display control circuit 200 outputs the row selection enable signals as described above and outputs the scanning signals as described above to the scanning signal line driving circuit 400, and thereby realizes the partial display.

<2.4 Effect of Second Embodiment>

As above, similarly to the case of the first embodiment, in the present embodiment, differently from the case where there is only one row selection enable signal EN, since a precharging period having a necessary length is always set with respect to a scanning signal line corresponding to a moving image region, and no unnecessary precharging period is set at all, abnormality of display gradation due to lack of the precharging period or display of noise due to addition of an unnecessary precharging period is not caused, so that it is possible to prevent display quality from being deteriorated. Further, similarly to the case of the first embodiment, it is possible to realize partial display with a simple configuration, and to reduce a region in which the patterns are stored.

3. Third Embodiment

<3.1 Entire Configuration and Operation of Liquid Crystal Display Device>

An entire configuration of a liquid crystal display device of an active matrix type according to a third embodiment of the invention is similar to that of the case of the first embodiment, and an equivalent circuit (refer to FIG. 2) of the pixel forming part P(n, m), a configuration of the scanning signal line driving circuit 400 (refer to FIG. 3), and the like in the display portion 500 are also similarly configured, so that description thereof will be omitted.

In the present embodiment, the moving image regions and the still image regions as illustrated in FIG. 20 are provided similarly to the case of the second embodiment, but differently from the case of the second embodiment and similarly to the case of the first embodiment, only four row selection enable signals are provided. Hereinafter, an operation of the display control circuit 200 will be described specifically with reference to FIG. 24.

<3.2 Operation of Display Control Circuit>

Figure 24:
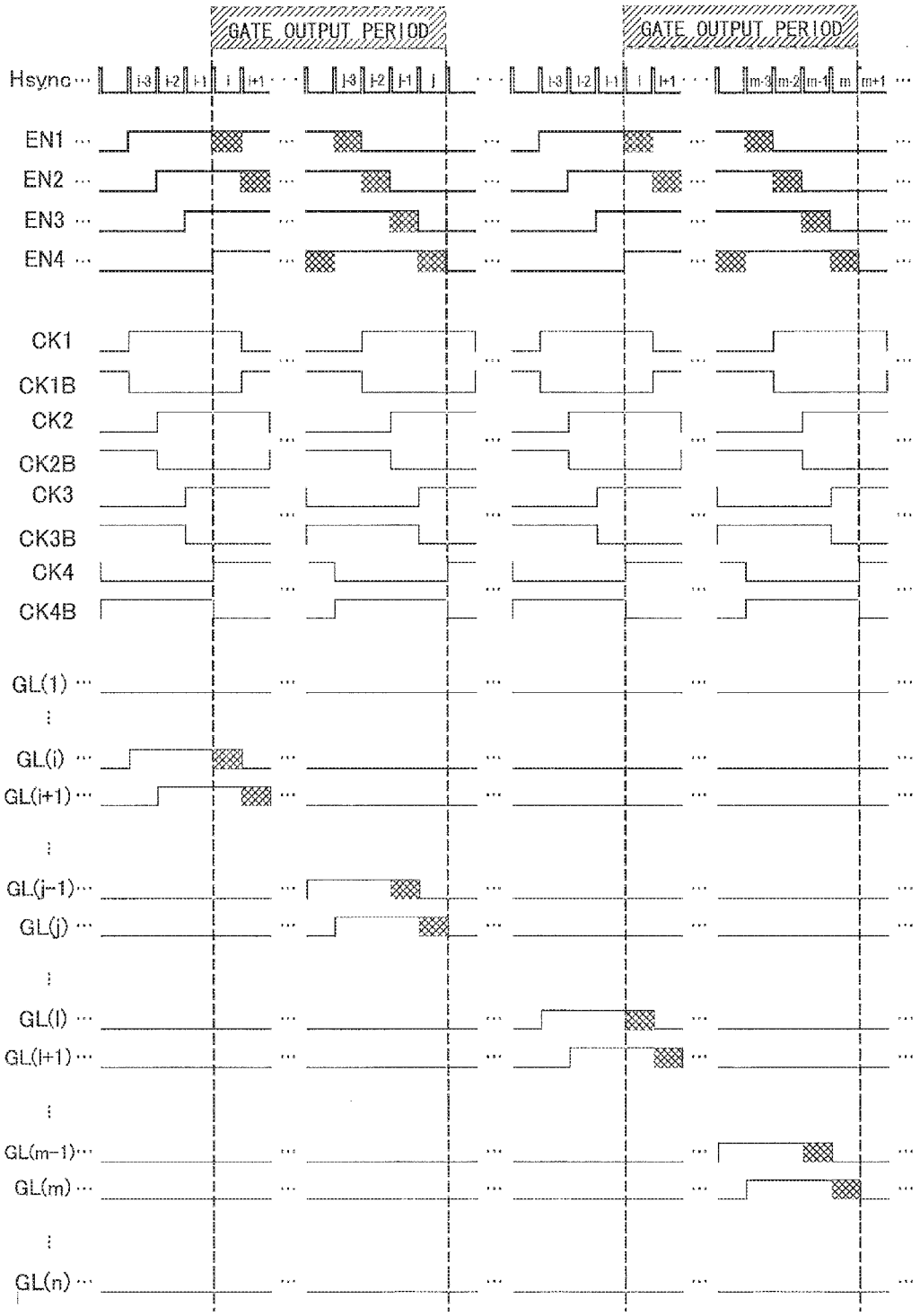
FIG. 24 is a waveform chart of various signals of second to sixtieth frames, during which only moving image regions are rewritten, in a third embodiment of the invention.

FIG. 24 is a waveform chart of various signals of second to sixtieth frames during which only moving image regions are rewritten. Similarly to the case of the first embodiment, which is indicated in FIG. 6, after a whole screen is rewritten, in the still image regions, a potential of a pixel capacitor is maintained as it is, and no scanning signal is supplied during a period from the second frame to the sixtieth frame. In the moving image regions, an image is rewritten for each frame. Accordingly, as indicated in FIG. 24, the row selection enable signals EN1 to EN4 become at the H level twice so that main charging periods are provided in a range from an ith row to a jth row and in a range from an lth row to an mth row, which individually correspond to the moving image regions, and precharging periods corresponding to the main charging periods are also provided, and thereby scanning signals including the main charging periods and the precharging periods are supplied to the scanning signal lines GL(i) to GL(j) and GL(1) to GL(m).

In addition, similarly to the first embodiment, in the present embodiment, waveform patterns of the row selection enable signals EN1 to EN4 merely need to have sixteen patterns in total, which are composed of four patterns of first rising time and four patterns of first falling time, and four patterns of second rising time and four patterns of second falling time, regardless of positions of starting rows and finishing rows of the moving image regions, so that it is possible to store the waveform patterns with a small storage capacity, and to perform control simply. Accordingly, it is possible to easily realize partial display only by selecting one of the patterns in accordance with each of the starting rows and each of the finishing rows of the moving image regions and setting rising time points and falling time points thereof. In addition, it is possible to reduce a region in which the patterns are stored.

Figure 25:
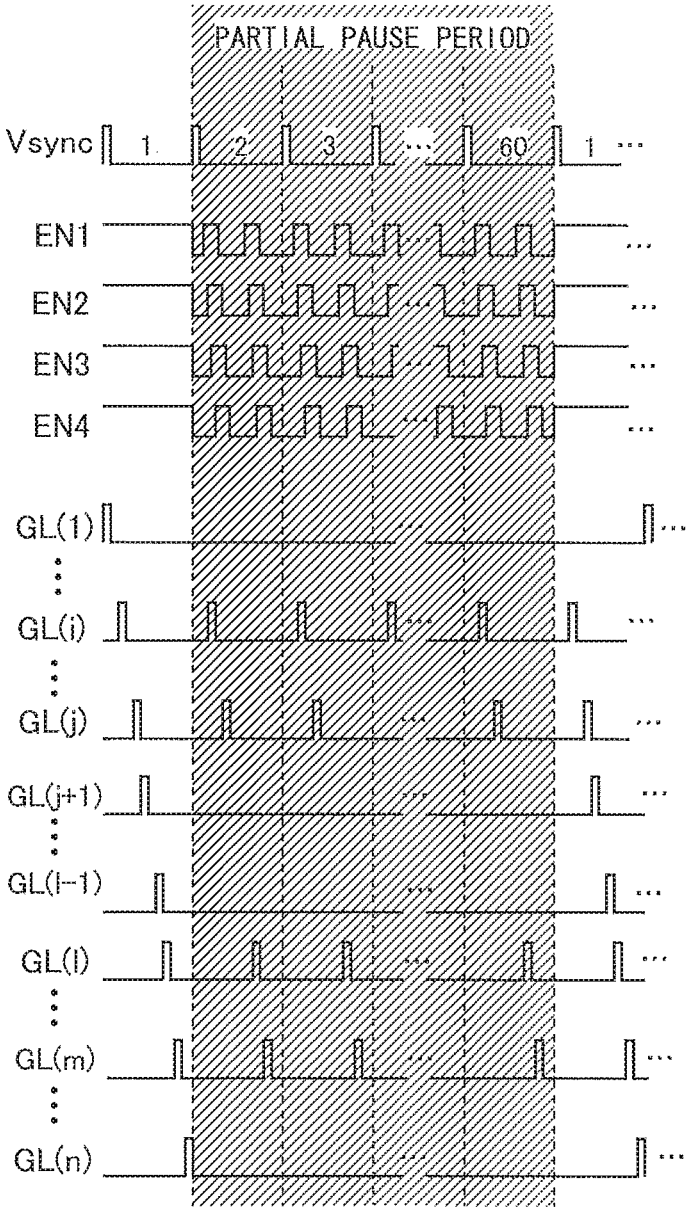
FIG. 25 is a waveform chart of various signals for performing partial display in first to sixtieth frame periods in the embodiment.

FIG. 25 is a waveform chart of various signals for performing partial display in the first to sixtieth frame periods. As described above, the partial display is realized by performing partial pause drive, by which rewriting is performed only once during sixty frame periods, in the still image regions illustrated in FIG. 20, and by performing normal drive, by which rewriting is performed for each frame period, in the moving image regions. Accordingly, as illustrated in FIG. 25, since the row selection enable signals EN1 to EN4 are always active in a vertical synchronizing period Vsync1 which indicates the first frame, a scanning signal including a main selection period is supplied to each of all the scanning signal lines GL(1) to GL(n). Thereafter, from the second frame to the sixtieth frame, a partial pause period, in which only the moving image regions are refreshed, is set as illustrated in FIG. 25, and the row selection enable signals EN1 to EN4 become active only during a period for performing display in the moving image regions, so that the scanning signals are supplied only to the scanning signal lines GL(i) to GL(j) and GL(1) to GL(m) and no scanning signal is supplied to the other scanning signal lines. The display control circuit 200 outputs the row selection enable signals as described above and outputs the scanning signals as described above to the scanning signal line driving circuit 400, and thereby realizes the partial display.

<3.3 Effect of Third Embodiment>

As above, similarly to the case of the first embodiment, in the present embodiment, differently from the case where there is only one row selection enable signal EN, since a precharging period having a necessary length is always set with respect to a scanning signal line corresponding to a moving image region, and no unnecessary precharging period is set at all, abnormality of display gradation due to lack of the precharging period or display of noise due to addition of an unnecessary precharging period is not caused, so that it is possible to prevent display quality from being deteriorated. Further, similarly to the case of the first embodiment, it is possible to realize partial display with a simple configuration, and to reduce a region in which the patterns are stored.

4. Others

Though each embodiment has been described above by citing an example of the liquid crystal display device of the frame inversion drive system, which has a precharging function, in the case of adopting the line inversion drive system which is a drive system by which a positive/negative polarity of a voltage applied to a pixel liquid crystal is inverted for each row in a display portion (and also inverted for each frame) or in the case of adopting a dot inversion drive system which is a drive system by which the positive/negative polarity is inverted for each row in a display portion and also inverted for each column (and also inverted for each frame), charging of a pixel capacitor in a precharging period does not always contribute to improvement of a charging rate in a main charging period. However, also in such a case, no problem is caused as to display, as long as the pixel capacitor is able to be sufficiently charged in the main charging period. Therefore, the invention is applicable also to a display device of the line inversion drive system and a display device of the dot inversion drive system.

Even when the line inversion drive system or the dot inversion drive system is adopted, by providing a precharging period, it is possible to reliably bring a scanning signal into an active state (at the H level) at least during a whole of the main charging period, so that it is possible to solve reduction in the charging rate due to waveform deterioration of the scanning signal. Thus, when taking improvement of the charging rate by "precharging of a scanning signal line" in a precharging period into consideration, the invention is effective also in the display device of the line inversion drive system and the display device of the dot inversion drive system.

INDUSTRIAL APPLICABILITY

The invention is applicable to a display device of an active matrix type and a display method in the display device, and is particularly suitable for a display device which performs partial display while selecting a plurality of scanning signal lines at the same time for precharging.

REFERENCE SIGNS LIST

10 TFT (thin film transistor)
21 timing control portion
22 moving image region determination portion
23 data selection portion
200 display control circuit
300 video signal line driving circuit
400 scanning signal line driving circuit
500 display portion
P(n, m) pixel forming part (pixel)
Epix pixel electrode
Ecom common electrode (counter electrode)
G(k) scanning signal (k=1, 2, 3, . . . )
GL(k) scanning signal line (k=1, 2, 3, . . . )
D(j) video signal (j=1, 2, 3, . . . )
SL(j) video signal line (j=1, 2, 3, . . . )
CT, CL control signal
EN1 to EN8 row selection enable signal

The invention claimed is:

1. A display device that displays an image by a plurality of pixel forming parts that are arranged along a plurality of video signal lines with which a plurality of video signals are transmitted and a plurality of scanning signal lines that intersect with the plurality of video signal lines, the display device comprising:

a video signal line driving circuit that drives the plurality of video signal lines based on an image signal that indicates the image;

a scanning signal line driving circuit that outputs a main selection signal, with which the plurality of scanning signal lines are individually selected per unit selection period in turn in order to cause the plurality of pixel forming parts to display the image, and a preliminary selection signal, with which the plurality of scanning signal lines are individually selected in turn during (n−1) (n is a natural number equal to or more than 2) unit selection period immediately before the main selection signal in order to perform preliminary charging before displaying the image, to each of the plurality of scanning signal lines so that phases are different between unit selection periods; and a display control circuit that controls the video signal line driving circuit and the scanning signal line driving circuit, wherein the display control circuit supplies, to the scanning signal line driving circuit, at least n row selection enable signals with which selection of a range of the plurality of scanning signal lines, which is designated from an outside of the device, is permitted, and causes a scanning signal line in the range to output the main selection signal and the preliminary selection signal and causes a scanning signal line outside the range to output neither the main selection signal nor the preliminary selection signal.

2. The display device according to claim 1, wherein the display control circuit supplies an n-phase clock signal, with which the preliminary selection signal and the main selection signal are generated, to the scanning signal line driving circuit, and supplies, to the scanning signal line driving circuit, the n row selection enable signals which store therein n patterns of rising time points and n patterns of falling time points of the n row selection enable signals, which are defined in advance, and rising time points and falling time points of which are determined in accordance with the range based on the stored patterns.

3. The display device according to claim 2, wherein the scanning signal line driving circuit causes the n row selection enable signals to respectively correspond to scanning signal line groups, which are obtained by being made into n groups, one by one based on the n-phase clock signal, and sequentially outputs the main selection signal and the preliminary selection signal to a scanning signal line for which selection is permitted by the row selection enable signals.

4. The display device according to claim 2, wherein the display control circuit determines rising time points and falling time points of the n row selection enable signals based on the rising time points of n patterns, which are defined in accordance with a remainder of dividing i (i is a natural number) by n, and the falling time points of n patterns, which are defined in accordance with a remainder of dividing m (m is a natural number larger than i) by n, based on an ith row serving as a starting row and an mth row serving as a finishing row in the range.

5. The display device according to claim 2, wherein the display control circuit determines first rising time points and first falling time points of the n row selection enable signals based on the rising time points of n patterns, which are defined in accordance with a remainder of dividing i (i is a natural number) by n, and the falling time points of n patterns, which are defined in accordance with a remainder of dividing j (j is a natural number larger than i) by n, based on an ith row serving as a starting row and a jth row serving as a finishing row in a first region of the first and a second regions in the range, which are different, and determines second rising time points and second falling time points of the n row selection enable signals based on the rising time points of n patterns, which are defined in accordance with a remainder of dividing 1 (1 is a natural number larger than j) by n, and the falling time points of n patterns, which are defined in accordance with a remainder of dividing m (m is a natural number larger than 1) by n, based on an lth row serving as a starting row and an mth row serving as a finishing row in the second region of the first and the second regions in the range, which are different.

6. The display device according to claim 1, wherein the display control circuit, based on the image signal, controls the video signal line driving circuit so as to drive the plurality of video signal lines in every predetermined frame cycle in a normal display region corresponding to the range in a display region of the image, and controls the video signal line driving circuit so as to drive the plurality of video signal lines in a cycle longer than the frame cycle in a pause drive region that is a display region other than the normal display region.

7. A display method of displaying an image on a display device that includes a plurality of pixel forming parts that are arranged along a plurality of video signal lines with which a plurality of video signals are transmitted and a plurality of scanning signal lines that intersect with the plurality of video signal lines, the method comprising:

a video signal line driving step of driving the plurality of video signal lines based on an image signal that indicates the image; and a scanning signal line driving step of outputting a main selection signal, with which the plurality of scanning signal lines are individually selected per unit selection period in turn in order to cause the plurality of pixel forming parts to display the image, and a preliminary selection signal, with which the plurality of scanning signal lines are individually selected in turn during (n−1) (n is a natural number equal to or more than 2) unit selection period immediately before the main selection signal in order to perform preliminary charging before displaying the image, to each of the plurality of scanning signal lines so that phases are different between unit selection periods; wherein at the scanning signal line driving step, in a case where a range in which selection is permitted among the plurality of scanning signal lines is designated from an outside of the device, based on at least n row selection enable signals with which selection of the range is permitted, the main selection signal and the preliminary selection signal are output to a scanning signal line in the range and neither the main selection signal nor the preliminary selection signal is output to a scanning signal line outside the range.

* * * * *